US009901794B2

(12) United States Patent
Beno et al.

(10) Patent No.: US 9,901,794 B2
(45) **Date of Patent: *Feb. 27, 2018**

(54) GOLF CLUB HEAD WITH REMOVABLE COMPONENT

(71) Applicant: Cobra Golf Incorporated, Carlsbad, CA (US)

(72) Inventors: Tim A. Beno, San Diego, CA (US); Joshua G. Breier, Vista, CA (US); Karl A. Clausen, Carlsbad, CA (US); Andrew Curtis, San Diego, CA (US); Caleb Kroloff, San Diego, CA (US); Steven M. Mitzel, San Marcos, CA (US); Scott H. Moreira, San Diego, CA (US); Richard Romo Sanchez, Temecula, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/213,297

(22) Filed: Jul. 18, 2016

(65) Prior Publication Data

US 2016/0325156 A1 Nov. 10, 2016

Related U.S. Application Data

(63) Continuation of application No. 14/150,035, filed on Jan. 8, 2014, now Pat. No. 9,393,471, which is a (Continued)

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/0466* (2013.01); *A63B 53/02* (2013.01);
(Continued)

(58) Field of Classification Search
CPC ..... A63B 53/06; A63B 53/0466; A63B 2053/0416; A63B 53/02; A63B 2209/00;
(Continued)

(56) References Cited

U.S. PATENT DOCUMENTS 713,845 A 11/1902 Braid
1,253,700 A 1/1918 Mclaughlin
(Continued)

FOREIGN PATENT DOCUMENTS

JP 8-089603 A 4/1996
JP 9-192269 A 7/1997
(Continued)

OTHER PUBLICATIONS

European Search Report for EP Appl. No. 10013627 4-2318 dated Mar. 11, 2011 (8 pages).
(Continued)

*Primary Examiner* — Sebastiano Passaniti
(74) *Attorney, Agent, or Firm* — Brown Rudnick LLP; Mark S. Leonardo

(57) ABSTRACT

The invention provides a golf club head with a fully removable component that can withstand the stress of repeated hits. When assembled, the removable component is held in place by a fastening mechanism that includes structural elements that distribute the holding force across the component and tend to equalize the forces around the periphery where the component meets the body. The fastening mechanism may include a post that reaches across the open space within the hollow club head, pulling the removable component towards an opposed main club head body. Since a golf
(Continued)

club of the present invention can be opened, it may include a mechanism on the inside for use by a golfer, such as an electronic device or an adjustment mechanism. The golf club may include a weight adjustment system that allows the club to be custom-fitted to a golfer.

11 Claims, 37 Drawing Sheets

Related U.S. Application Data continuation-in-part of application No. 13/545,329, filed on Jul. 10, 2012, now abandoned, which is a continuation-in-part of application No. 13/539,958, filed on Jul. 2, 2012, said application No. 13/545,329 is a continuation-in-part of application No. 13/407,087, filed on Feb. 28, 2012, now abandoned, which is a continuation-in-part of application No. 12/643,154, filed on Dec. 21, 2009, now Pat. No. 8,147,354, said application No. 13/545,329 is a continuation-in-part of application No. 13/185,324, filed on Jul. 18, 2011, now Pat. No. 8,226,499, which is a continuation of application No. 12/696,468, filed on Jan. 29, 2010, now Pat. No. 7,980,964, which is a continuation of application No. 11/110,733, filed on Apr. 21, 2005, now Pat. No. 7,658,686.

(60) Provisional application No. 61/513,509, filed on Jul. 29, 2011.

(51) Int. Cl.

| | |
|---|---|
| ***A63B 59/00*** | (2015.01) |
| *A63B 53/02* | (2015.01) |
| *A63B 60/52* | (2015.01) |
| *A63B 60/54* | (2015.01) |
| *A63B 60/42* | (2015.01) |

(52) U.S. Cl.

CPC ..... *A63B 60/42* (2015.10); *A63B 60/52* (2015.10); *A63B 60/54* (2015.10); *A63B 2053/045* (2013.01); *A63B 2053/0416* (2013.01); *A63B 2053/0433* (2013.01); *A63B 2053/0437* (2013.01); *A63B 2053/0491* (2013.01); *A63B 2209/00* (2013.01); *A63B 2209/10* (2013.01)

(58) Field of Classification Search

CPC ..... A63B 2209/10; A63B 2053/0433; A63B 2053/0491; A63B 2053/0437; A63B 2053/045; A63B 60/52; A63B 60/54; A63B 60/42

USPC ..... 473/324–350, 287–292

See application file for complete search history.

(56) References Cited

U.S. PATENT DOCUMENTS 1,349,806 A 8/1920 Booth
1,361,258 A 12/1920 Horton
1,412,650 A 4/1922 Booth
1,452,845 A 4/1923 Pryde
1,455,379 A 5/1923 Allen
1,552,297 A 9/1925 Harness
1,559,299 A 10/1925 Barach
1,574,213 A 2/1926 Tyler
1,575,364 A 3/1926 Hodgkins
1,665,523 A 4/1928 Boyce
1,705,997 A 3/1929 Williams
1,879,117 A 9/1932 Davidson
2,076,340 A 4/1937 William
2,163,091 A 6/1939 Held
2,171,383 A 8/1939 Wettlaufer
3,096,982 A 7/1963 Bassin
3,166,320 A 1/1965 Onions
3,524,646 A 8/1970 Wheeler
3,556,533 A 1/1971 Hollis
3,640,534 A 2/1972 Mills
3,692,306 A 9/1972 Glover
3,866,348 A * 2/1975 Roby ..... A63H 3/16 273/276
3,941,390 A 3/1976 Hussey
3,966,210 A 6/1976 Rozmus
D240,644 S 7/1976 Manfrin
3,979,123 A 9/1976 Belmont
3,985,363 A 10/1976 Jepson et al.
4,021,047 A 5/1977 Mader
4,043,563 A 8/1977 Churchward
4,052,075 A 10/1977 Daly
4,063,737 A 12/1977 Tom et al.
4,067,572 A 1/1978 Coleman
4,085,934 A 4/1978 Churchward
4,193,601 A 3/1980 Reid, Jr. et al.
4,194,739 A 3/1980 Thompson
D262,049 S 11/1981 Simmons
4,313,607 A 2/1982 Thompson
4,325,553 A 4/1982 Taylor
4,340,230 A 7/1982 Churchward
4,385,467 A * 5/1983 Samuels ..... A63F 9/1011 273/157 R
4,432,549 A 2/1984 Zebelean
4,438,931 A 3/1984 Motomiya
4,502,687 A 3/1985 Kochevar
4,653,756 A 3/1987 Sato
4,714,577 A 12/1987 Nagamoto et al.
4,762,322 A 8/1988 Molitor et al.
4,767,298 A 8/1988 Bocchicchio et al.
4,792,140 A 12/1988 Yamaguchi et al.
4,869,507 A 9/1989 Sahm
4,872,683 A 10/1989 Doran et al.
4,872,685 A 10/1989 Sun
4,883,275 A 11/1989 Boone
4,895,371 A 1/1990 Bushner
4,930,781 A 6/1990 Allen
4,971,238 A 11/1990 Furutsu
4,971,328 A * 11/1990 Hernberg ..... A63B 69/3614 273/DIG. 30
5,039,098 A 8/1991 Pelz
5,050,879 A 9/1991 Sun et al.
5,135,227 A 8/1992 Okumoto et al.
5,161,802 A * 11/1992 Daechsel ..... A63B 69/3614 473/220
5,186,465 A 2/1993 Chorne
5,205,560 A 4/1993 Hoshi et al.
5,213,328 A 5/1993 Long et al.
5,255,913 A 10/1993 Tsuchida
5,272,802 A 12/1993 Stites, III
5,294,037 A * 3/1994 Schmidt ..... A63B 53/04 228/125
5,310,186 A 5/1994 Karsten
5,328,176 A 7/1994 Lo
5,346,217 A 9/1994 Tsuchiya et al.
5,388,827 A 2/1995 Reynolds, Jr.
5,429,365 A 7/1995 McKeighen
5,433,442 A 7/1995 Walker
5,435,558 A 7/1995 Iriarte
5,447,309 A 9/1995 Vincent
5,464,216 A 11/1995 Hoshi et al.
5,474,297 A 12/1995 Levin
5,482,281 A 1/1996 Anderson
5,484,155 A 1/1996 Yamawaki et al.
5,509,660 A 4/1996 Elmer
5,518,240 A 5/1996 Igarashi
5,518,243 A 5/1996 Redman
5,540,435 A 7/1996 Kawasaki
5,547,188 A 8/1996 Dumontier et al.
5,582,553 A 12/1996 Ashcraft et al.
5,586,944 A 12/1996 Nagamoto et al.
5,620,378 A 4/1997 Fritz et al.

(56) References Cited

U.S. PATENT DOCUMENTS 5,624,331 A 4/1997 Lo et al.
5,665,014 A 9/1997 Sanford et al.
5,683,309 A 11/1997 Reimers
5,718,641 A 2/1998 Lin
5,720,674 A 2/1998 Galy
5,769,735 A 6/1998 Hosokawa
5,769,736 A 6/1998 Sato
5,776,011 A 7/1998 Su et al.
5,785,609 A 7/1998 Sheets et al.
5,788,587 A 8/1998 Tseng
5,797,176 A 8/1998 Rose et al.
5,807,188 A 9/1998 Serrano et al.
5,816,927 A 10/1998 Taylor
5,842,935 A 12/1998 Nelson
5,871,784 A 2/1999 Assink et al.
5,911,638 A 6/1999 Parente et al.
5,916,042 A 6/1999 Reimers
5,921,872 A 7/1999 Kobayashi
5,935,020 A 8/1999 Stites et al.
5,947,840 A 9/1999 Ryan
5,971,867 A 10/1999 Galy
5,997,415 A 12/1999 Wood
D418,885 S 1/2000 Wanchena
6,012,989 A 1/2000 Saksun, Sr.
6,033,318 A 3/2000 Drajan, Jr. et al.
6,059,669 A 5/2000 Pearce
6,074,308 A 6/2000 Domas
6,077,171 A 6/2000 Yoneyama
6,089,994 A 7/2000 Sun
6,102,813 A 8/2000 Dill
6,123,627 A 9/2000 Antonious
6,139,446 A 10/2000 Wanchena
6,149,534 A 11/2000 Peters et al.
6,162,133 A 12/2000 Peterson
6,183,377 B1 2/2001 Liang
6,217,461 B1 4/2001 Galy
6,224,493 B1 * 5/2001 Lee ..... A63B 69/3614 473/221
6,248,025 B1 6/2001 Murphy et al.
6,248,026 B1 6/2001 Wanchena
6,254,494 B1 7/2001 Hasebe et al.
6,277,032 B1 8/2001 Smith
6,280,349 B1 8/2001 Cook
6,296,470 B1 10/2001 Lanser et al.
6,306,048 B1 10/2001 McCabe et al.
6,332,848 B1 12/2001 Long et al.
6,340,337 B2 1/2002 Hasebe et al.
6,354,962 B1 3/2002 Galloway et al.
6,354,963 B1 3/2002 Kodama et al.
6,379,265 B1 4/2002 Hirakawa et al.
6,381,828 B1 5/2002 Boyce et al.
6,409,612 B1 6/2002 Evans et al.
6,422,951 B1 7/2002 Burrows
6,440,009 B1 8/2002 Guibaud et al.
6,442,951 B1 9/2002 Maeda et al.
6,471,604 B2 10/2002 Hocknell et al.
6,482,106 B2 11/2002 Saso
6,514,154 B1 2/2003 Finn
6,547,673 B2 4/2003 Roark
6,558,271 B1 5/2003 Beach et al.
6,565,425 B1 5/2003 Wuensch
6,565,452 B2 5/2003 Helmstetter et al.
6,572,491 B2 6/2003 Hasebe et al.
6,575,845 B2 6/2003 Galloway et al.
6,592,468 B2 7/2003 Vincent et al.
6,592,469 B2 7/2003 Gilbert
6,602,149 B1 8/2003 Jacobson
6,623,378 B2 9/2003 Beach et al.
6,645,086 B1 11/2003 Chen
6,648,773 B1 11/2003 Evans
6,663,504 B2 12/2003 Hocknell et al.
6,669,576 B1 12/2003 Rice
6,695,608 B2 2/2004 Murphy et al.
6,716,114 B2 4/2004 Nishio
6,739,982 B2 5/2004 Murphy et al.
6,739,983 B2 5/2004 Helmstetter et al.
6,739,984 B1 5/2004 Ciasullo
6,769,996 B2 8/2004 Tseng
6,773,360 B2 8/2004 Willett et al.
6,776,723 B2 8/2004 Bliss et al.
6,840,755 B1 1/2005 Cook
6,860,818 B2 3/2005 Mahaffey
6,860,823 B2 3/2005 Lee
6,863,620 B2 3/2005 Tucker, Sr.
6,872,152 B2 3/2005 Beach et al.
6,890,267 B2 5/2005 Mahaffey et al.
6,896,625 B2 5/2005 Grace
6,902,497 B2 6/2005 Deshmukh et al.
6,913,542 B1 7/2005 Hu et al.
6,913,546 B2 7/2005 Kakiuchi
6,921,343 B2 7/2005 Solheim
6,926,615 B1 8/2005 Souza et al.
6,929,565 B2 8/2005 Nakahara et al.
6,932,875 B2 8/2005 Cheng et al.
6,935,965 B1 * 8/2005 DeVarney ..... A63B 69/3635 473/224
6,955,612 B2 10/2005 Lu
6,988,956 B2 1/2006 Cover et al.
6,991,555 B2 1/2006 Reese
6,991,558 B2 1/2006 Beach et al.
7,004,852 B2 2/2006 Billings
7,008,332 B2 3/2006 Liou
7,022,030 B2 4/2006 Best et al.
7,025,692 B2 4/2006 Erickson et al.
7,041,005 B2 5/2006 Beach et al.
7,063,629 B2 6/2006 Nakahara et al.
7,070,517 B2 7/2006 Cackett et al.
7,094,159 B2 8/2006 Takeda
7,108,609 B2 9/2006 Stites et al.
7,128,664 B2 10/2006 Onoda et al.
7,140,974 B2 11/2006 Chao et al.
7,147,573 B2 12/2006 DiMarco
7,156,752 B1 1/2007 Bennett
7,160,040 B2 1/2007 Matsushima
7,163,468 B2 1/2007 Gibbs et al.
7,166,038 B2 1/2007 Williams et al.
7,166,040 B2 1/2007 Hoffman et al.
7,169,060 B2 1/2007 Stevens et al.
7,175,541 B2 2/2007 Lo
7,186,190 B1 3/2007 Beach et al.
7,204,768 B2 4/2007 Nakahara et al.
7,207,898 B2 4/2007 Rice et al.
7,217,199 B2 5/2007 Nakahara et al.
7,244,188 B2 7/2007 Best
7,252,599 B2 8/2007 Hasegawa
7,258,624 B2 8/2007 Kobayashi
7,258,625 B2 8/2007 Kawaguchi et al.
7,281,993 B2 10/2007 Oyama
7,281,994 B2 10/2007 De Shiell et al.
7,297,072 B2 11/2007 Meyer et al.
7,303,487 B2 12/2007 Kumamoto
7,338,390 B2 3/2008 Lindsay
D567,888 S 4/2008 Soracco
7,371,191 B2 5/2008 Sugimoto
7,377,860 B2 5/2008 Breier et al.
7,419,441 B2 9/2008 Hoffman et al.
7,491,131 B2 2/2009 Vinton
7,524,149 B2 4/2009 Heule et al.
7,524,249 B2 4/2009 Breier et al.
7,530,901 B2 5/2009 Imamoto et al.
7,549,933 B2 6/2009 Kumamoto
7,566,279 B2 7/2009 Nakashima
7,601,078 B2 10/2009 Mergy et al.
7,625,298 B2 12/2009 Bennett
7,632,195 B2 12/2009 Jorgensen
7,658,686 B2 2/2010 Soracco
7,753,809 B2 7/2010 Cackett et al.
7,758,451 B2 7/2010 Liang et al.
7,771,290 B2 8/2010 Bezilla et al.
7,789,766 B2 9/2010 Morris et al.
7,803,065 B2 9/2010 Breier et al.
7,806,782 B2 10/2010 Stites et al.
7,819,754 B2 10/2010 Evans et al.
7,819,758 B2 10/2010 Matsunaga et al.

(56) References Cited

U.S. PATENT DOCUMENTS 7,854,665 B2 12/2010 Dewhurst et al.
7,938,740 B2 5/2011 Breier et al.
7,959,522 B2 6/2011 North, III et al.
7,980,499 B2 7/2011 Price
7,980,964 B2 7/2011 Soracco
8,007,371 B2 8/2011 Breier et al.
8,007,373 B2 8/2011 Soracco et al.
8,033,930 B2 10/2011 Tavares et al.
8,038,545 B2 10/2011 Soracco
8,057,323 B2 11/2011 Liang et al.
8,062,151 B2 11/2011 Boyd et al.
8,133,128 B2 3/2012 Boyd et al.
8,133,129 B2 3/2012 Boyd et al.
8,147,354 B2 4/2012 Hartwell et al.
8,162,776 B2 4/2012 Boyd et al.
8,206,243 B2 6/2012 Stites
8,216,087 B2 7/2012 Breier et al.
8,226,499 B2 7/2012 Soracco
8,303,433 B2 11/2012 Roach et al.
8,337,319 B2 12/2012 Sargent et al.
8,376,873 B2 2/2013 Golden et al.
8,382,607 B2 2/2013 Burnett et al.
8,409,025 B2 * 4/2013 Stites ..... A63B 69/3614 473/219
8,435,135 B2 5/2013 Stites et al.
8,460,592 B2 6/2013 Breier et al.
8,485,920 B2 7/2013 Breier et al.
8,523,705 B2 9/2013 Breier et al.
8,585,514 B2 11/2013 Boyd et al.
8,834,294 B1 9/2014 Seluga et al.
8,938,871 B2 1/2015 Roach et al.
9,067,110 B1 6/2015 Seluga et al.
9,199,143 B1 12/2015 Parsons et al.
9,393,471 B2 7/2016 Beno et al.
9,421,438 B2 8/2016 Beno et al.
9,440,123 B2 9/2016 Beno et al.
9,504,889 B2 11/2016 Mitzel et al.
9,616,301 B2 4/2017 Clausen et al.
2001/0001302 A1 5/2001 Murphy et al.
2001/0049310 A1 12/2001 Cheng et al.
2002/0045490 A1 4/2002 Ezawa et al.
2002/0049093 A1 4/2002 Reyes et al.
2002/0077195 A1 6/2002 Carr et al.
2002/0137576 A1 9/2002 Dammen
2002/0160858 A1 10/2002 Lee
2003/0045371 A1 3/2003 Wood et al.
2003/0100381 A1 5/2003 Murphy et al.
2003/0130059 A1 7/2003 Billings
2003/0134690 A1 7/2003 Chen
2003/0134693 A1 7/2003 Nakahara et al.
2003/0144078 A1 7/2003 Setokawa et al.
2003/0162608 A1 8/2003 Chen
2004/0116207 A1 6/2004 De Shiell et al.
2004/0116208 A1 6/2004 De Shiell et al.
2004/0138002 A1 7/2004 Murray
2004/0176177 A1 9/2004 Mahaffey et al.
2004/0192468 A1 9/2004 Onoda et al.
2004/0224790 A1 11/2004 Lu
2004/0242343 A1 12/2004 Chao et al.
2004/0254030 A1 12/2004 Nishitani et al.
2005/0026723 A1 2/2005 Kumamoto
2005/0037862 A1 * 2/2005 Hagood ..... A63B 53/04 473/222
2005/0090330 A1 4/2005 Kumamoto
2005/0101408 A1 5/2005 Sanchez et al.
2005/0119070 A1 6/2005 Kumamoto
2005/0159243 A1 7/2005 Chuang
2005/0170907 A1 8/2005 Saso
2005/0215354 A1 9/2005 Kumamoto
2005/0272527 A1 12/2005 Sugimoto
2006/0014592 A1 1/2006 Sugimoto
2006/0019770 A1 1/2006 Meyer et al.
2006/0052177 A1 3/2006 Nakahara et al.
2006/0052181 A1 3/2006 Serrano et al.
2006/0073911 A1 4/2006 Kusumoto
2006/0084521 A1 4/2006 Mori et al.
2006/0084525 A1 4/2006 Imamoto et al.
2006/0100032 A1 5/2006 Imamoto et al.
2006/0105855 A1 5/2006 Cackett et al.
2006/0116218 A1 6/2006 Burnett et al.
2006/0240907 A1 10/2006 Latiri
2007/0037630 A1 * 2/2007 Hsiao ..... A63B 53/0466 473/220
2007/0054751 A1 3/2007 Breier et al.
2007/0060414 A1 3/2007 Breier et al.
2007/0155532 A1 7/2007 Adams
2007/0249432 A1 10/2007 Wu
2007/0265109 A1 11/2007 Elmer
2008/0058117 A1 3/2008 Roach
2008/0070721 A1 3/2008 Chen et al.
2008/0102975 A1 5/2008 Chen
2008/0102978 A1 5/2008 Burnett et al.
2008/0125236 A1 * 5/2008 Kelly ..... A63B 69/3632 473/223
2008/0227564 A1 9/2008 Breier et al.
2008/0230948 A1 9/2008 Salvador et al.
2008/0242445 A1 10/2008 Mergy et al.
2008/0261715 A1 10/2008 Carter
2008/0268980 A1 10/2008 Breier et al.
2008/0293510 A1 11/2008 Yamamoto
2009/0105010 A1 4/2009 De La Cruz et al.
2009/0118034 A1 5/2009 Yokota
2009/0186717 A1 7/2009 Stites et al.
2009/0203465 A1 8/2009 Stites et al.
2010/0041490 A1 2/2010 Boyd et al.
2010/0041493 A1 2/2010 Clausen et al.
2010/0041495 A1 2/2010 North, III et al.
2010/0056297 A1 3/2010 Roach et al.
2010/0093458 A1 * 4/2010 Davenport ..... A63B 53/0466 473/223
2010/0105499 A1 4/2010 Roach et al.
2010/0130304 A1 5/2010 Soracco
2010/0130305 A1 5/2010 Soracco
2010/0151962 A1 6/2010 Breier et al.
2010/0160091 A1 6/2010 Boyd et al.
2010/0255922 A1 * 10/2010 Lueders ..... A63B 53/0487 473/224
2010/0261543 A1 10/2010 Breier et al.
2010/0285900 A1 11/2010 Lukasiewicz, Jr. et al.
2010/0298065 A1 11/2010 Soracco et al.
2010/0331103 A1 12/2010 Takahashi et al.
2011/0021282 A1 1/2011 Sander
2011/0045921 A1 2/2011 Evans
2011/0053706 A1 3/2011 Breier et al.
2011/0081986 A1 4/2011 Stites
2011/0098128 A1 4/2011 Clausen et al.
2011/0111885 A1 5/2011 Golden et al.
2011/0118057 A1 5/2011 Roach et al.
2011/0151989 A1 6/2011 Golden et al.
2011/0152003 A1 6/2011 Hartwell et al.
2011/0159986 A1 6/2011 Chao et al.
2011/0207547 A1 8/2011 Sander et al.
2011/0272846 A1 11/2011 Breier et al.
2011/0275455 A1 11/2011 Soracco
2011/0277313 A1 11/2011 Soracco et al.
2011/0312437 A1 12/2011 Sargent et al.
2012/0064991 A1 3/2012 Evans
2012/0129621 A1 5/2012 Boyd et al.
2013/0178306 A1 7/2013 Beno et al.
2014/0274462 A1 9/2014 Sander
2017/0072275 A1 3/2017 Mitzel et al.

FOREIGN PATENT DOCUMENTS

JP 2000-024149 A 1/2000
JP 2002-336389 A 11/2002
JP 2003-093554 A 4/2003
JP 2003-310808 A 11/2003
JP 2004-121744 A 4/2004
JP 2004-159680 A 6/2004
JP 2004-337327 12/2004
JP 2004-337327 A 12/2004
JP 2006-25929 2/2006

(56) References Cited

FOREIGN PATENT DOCUMENTS

| | | | |
|---|---|---|---|
| JP | 2006-025929 | A | 2/2006 |
| JP | 2006-130065 | A | 5/2006 |
| WO | 2004/052472 | A1 | 6/2004 |
| WO | 2007/101350 | A1 | 9/2007 |

OTHER PUBLICATIONS

Jackson, J., The Modern Guide to Golf Clubmaking, p. 239, Dynacraft, Ohio (3 pages).
Japanese Office Action for JP Appl. 2007-311561 dated Jun. 30, 2010 (7 pages).
Japanese Office Action for JP Appl. 2007-085624 dated Jul. 7, 2010 (6 pages).
Non-Final Office Action dated May 20, 2009 for U.S. Appl. No. 11/110,733 (13 pages).
Final Office Action dated Oct. 1, 2008 for U.S. Appl. No. 11/110,733 (15 pages).
Non-Final Office Action dated Dec. 31, 2007 for U.S. Appl. No. 11/110,733 (11 pages).
Non-Final Office Action dated Jun. 5, 2007 for U.S. Appl. No. 11/110,733 (9 pages).
Notice of Allowance dated Dec. 31, 2008 for U.S. Appl. No. 11/363,098 (6 pages).
Non-Final Office Action dated Jun. 12, 2008 for U.S. Appl. No. 11/363,098 (11 pages).
Non-Final Office Action dated Oct. 27, 2009 for U.S. Appl. No. 11/591,588 (14 pages).
Non-Final Office Action dated Dec. 7, 2009 for U.S. Appl. No. 11/898,756 (10 pages).
Non-Final Office Action dated Nov. 13, 2009 for U.S. Appl. No. 11/600,081 (14 pages).
Notice of Allowance dated Sep. 28, 2009 for U.S. Appl. No. 11/110,733 (6 pages).
Jackson, Jeff, The Modern Guide to Golf Clubmaking, Ohio: Dynacraft Golf Products, Inc. copyright 1994, p. 239.
Japanese Office Action for Application No. 2007-311561, dated Jun. 30, 2010, in 7 pages.
Japanese Office Action titled Pretrial Reexamination Report for Japanese Application No. 2007-085624, (Appeal Trial No. 2010-009497), dated Jul. 7, 2010, in 6 pages.
Notice of Allowance dated Sep. 28, 2009 of corresponding U.S. Appl. No. 11/110,733.
Non-Final Office Action dated May 20, 2009 of corresponding U.S. Appl. No. 11/110,733.
Final Office Action dated Oct. 1, 2008 of corresponding U.S. Appl. No. 11/110,733.
Non-Final Office Action dated Dec. 31, 2007 of corresponding U.S. Appl. No. 11/110,733.
Non-Final Office Action dated Jun. 5, 2007 of corresponding U.S. Appl. No. 11/110,733.
Notice of Allowance dated Dec. 31, 2008 of corresponding U.S. Appl. No. 11/363,098.
Non-Final Office Action dated Jun. 12, 2008 of corresponding U.S. Appl. No. 11/363,098.
Non-Final Office Action dated Oct. 27, 2009 of corresponding U.S. Appl. No. 11/591,588.
Non-Final Office Action dated Dec. 7, 2009 of corresponding U.S. Appl. No. 11/898,756.
Non-Final Office Action dated Nov. 13, 2009 of corresponding U.S. Appl. No. 11/600,081.
European Search Report for European Application No. 10013627.4-2318, dated Mar. 11, 2011, in 8 pages.

* cited by examiner

GOLF CLUB HEAD WITH REMOVABLE COMPONENT

CROSS-REFERENCE TO RELATED APPLICATIONS

This application is a continuation of U.S. patent application Ser. No. 14/150,035, filed Jan. 8, 2014, which is a continuation-in-part of U.S. patent application Ser. No. 13/545,329, filed Jul. 10, 2012, which is a continuation-in-part of U.S. patent application Ser. No. 13/185,324, filed Jul. 18, 2011 (now U.S. Pat. No. 8,226,499), which is a continuation of U.S. patent application Ser. No. 12/696,468, filed Jan. 29, 2010 (now U.S. Pat. No. 7,980,964), which is a continuation of U.S. patent application Ser. No. 11/110,733, filed Apr. 21, 2005 (now U.S. Pat. No. 7,658,686).

U.S. patent application Ser. No. 13/545,329, filed Jul. 10, 2012, is also a continuation-in-part of U.S. patent application Ser. No. 13/539,958, filed Jul. 2, 2012, which is claims the benefit of and priority to U.S. Provisional Application No. 61/513,509, filed Jul. 29, 2011.

U.S. patent application Ser. No. 13/545,329, filed Jul. 10, 2012, is also a continuation-in-part of U.S. patent application Ser. No. 13/407,087, filed Feb. 28, 2012, which is a continuation-in-part of U.S. patent application Ser. No. 12/643,154, filed Dec. 21, 2009 (now U.S. Pat. No. 8,147,354).

The contents of each of the above listed applications are hereby incorporated by reference herein in their entireties.

FIELD OF THE INVENTION

The present invention relates to a golf club, and more particularly to a wood-type club head with separable components.

BACKGROUND

Some golfers desire a golf club that they can personalize to their playing style. For example, increasing heel or toe-weighting can help correct for a hook or a slice. However, adjustable golf clubs are fraught with problems. The adjustment mechanisms interfere with golf club aerodynamics and also trap soil or other environmental grime. Also, since the adjustment mechanisms can be fragile, they can break during golf. Additionally, the adjustment mechanisms add undesirable mass to the club head.

Some attempts have been made to move the mechanisms to the interior of the golf club. For example, U.S. Pat. No. 8,206,243 to Stites describes a club head with movable weight members contained internally. Unfortunately, the removable crown part for accessing the weight members may not cope with stress well. During a powerful drive, the crown may crack or pop off of the club head, causing great frustration to the golfer. It may be found that the removable crown—having much less structural support than the material of the body surrounding the crown—deforms differently than the body and flexes out of shape relative to the body, leading to rapid failures. Also, some removable body part designs such as shown in U.S. Pat. No. 8,435,135 to Stites do not really open up a hollow club head, but simply add a component on top of a fully enclosed part of a club head, or they only provide very limited access to the interior of the club head (e.g., U.S. Pub. 2010/0160091 to Boyd).

SUMMARY

The invention provides a golf club head with a fully removable component that can withstand the stress of repeated hits. When assembled, the removable component is held in place by a fastening mechanism that holds the component against the club head body. The fastening mechanism includes structural elements that distribute the holding force across the component and tend to equalize the forces around the periphery where the component meets the body. The fastening mechanism may include a post that reaches across the open space within the hollow club head, pulling the removable component towards an opposed main club head body. Preferably, the post receives an assembly screw. The post is connected to the removable component via a plurality of radiating truss structures to distribute forces across the component. The removable component is mated to the club head body at an opening in the body with a periphery complementary to a periphery of the component. The fastening mechanism tends to equalize stresses around this periphery, thus creating a golf club that can be opened but that is also highly effective for playing golf as well as being durable.

Since a golf club of the present invention can be opened, it may include a mechanism on the inside for use by a golfer, such as an electronic device or an adjustment mechanism. The golf club may include a weight adjustment system that allows the club to be custom-fitted to a golfer. A weight adjustment system can include a plurality of mount points at which one or more removable weights can be mounted. For example, each mount point can include a threaded receptacle and each weight can include a threaded post. Additionally or alternatively, the club head can include a non-threaded adjustment system that uses Velcro or an adhesive to provide a highly-adjustable mass distribution system. In some embodiments, the adjustment system uses other means such as channels, prongs, spikes, edges, etc., and attachable material such as silicone caulk or other sticky or gummy material that can be pressed in. The adjustment system can include snap-together or snap-in weights or any other suitable mechanism. Where the club head uses threaded weight members, the club head can be provided along with a tool for tightening the weight down on a mount point or removing it. In this way, a golfer can have the club fitted to his or her personal playing style, and can close the club by fastening the removable component in place so that an exterior of the club is smooth and free of features relating to weight mounting and thus can be aerodynamically optimized.

Since the adjustable components are contained within an enclosed club head, they are additionally protected from the elements. The adjustable components themselves will not tarnish through rapid exposure to environmental elements. Additionally, the exterior surface of the club head has minimal creases, deformations, inlets, or pockets that may trap and retain dirt and grime—which could otherwise interfere with the mass distribution of the club head.

In certain aspects, the invention provides a golf club head that includes a main club head body member defining a hosel, a ball-striking face, and at least a portion of a crown and a sole of the golf club head. The club head has a removable component interchangeably coupleable to the main club head body member at an attachment perimeter to create a playable club. The removable component may be a crown or a sole, for example, or the removable component may define a two-part club head (e.g., a clam-shell club head) or a multi-part club head.

The attachment perimeter may include a plurality of tabs and corresponding recesses. Preferably, the main club head body member includes a boss with a screw extending therethrough, the screw being threadably engaged with a post extending from an inner surface of the removable component. A washer may be included, disposed around the screw and retaining the screw within the boss. The removable component may include a majority of a crown and may optionally also include a portion or a majority of a heel-side skirt of the club head, a portion or a majority of a toe-side skirt of the club head, or both. The main club head body member may define a face cup, a hosel, and at least a portion of a sole of the club head. In some embodiments, the main club head body member comprises a majority of the sole.

In certain embodiments, the main body member includes a first piece defining the hosel and surrounding the ball-striking face, and an intermediate piece connected to the first and defining a cutaway with an inner periphery at the attachment perimeter.

In some embodiments, the club head body includes at least one mount point on an inside surface for attachment of a removable weight. The club head preferably also includes a weight attached to at least one of the mount points. The club head may include a plurality of mount points, wherein the removable weight can be threadably attached to any one of the plurality of mount points. Each mount point may include a casting and a threaded insert disposed within the casting.

Aspects of the invention provide a system for fitting a golf club that includes a hollow golf club head defining a crown, a sole, a hosel, and a ball striking face. The system also includes a plurality of mount points disposed on an inner surface of the golf club head with at least one weight member releasably coupleable to any of the plurality of mount points and a removable component for accessing the weight member and the mount points. The plurality of mount points may include at least one mount point on a toe-side of an inside surface of the sole, at least one mount point on a heel side of an inside surface of the sole, or both. Additionally or alternatively, the plurality of mount points includes at least one mount point on a forward area of an inside surface of the sole, at least one mount point on an aft area of an inside surface of the sole, or both. In some embodiments, each mount point comprises a raised casting with a threaded insert therein.

Each weight member may include a rigid body, a viscoelastic dampener on a mounting side of the rigid body, a threaded post extending from the mounting side, and a tool interface obverse to the threaded post. The weight member can have a screw extending through the rigid body and providing the threaded post, and a retaining washer holding the screw in the rigid body.

DETAILED DESCRIPTION

Figure 1:
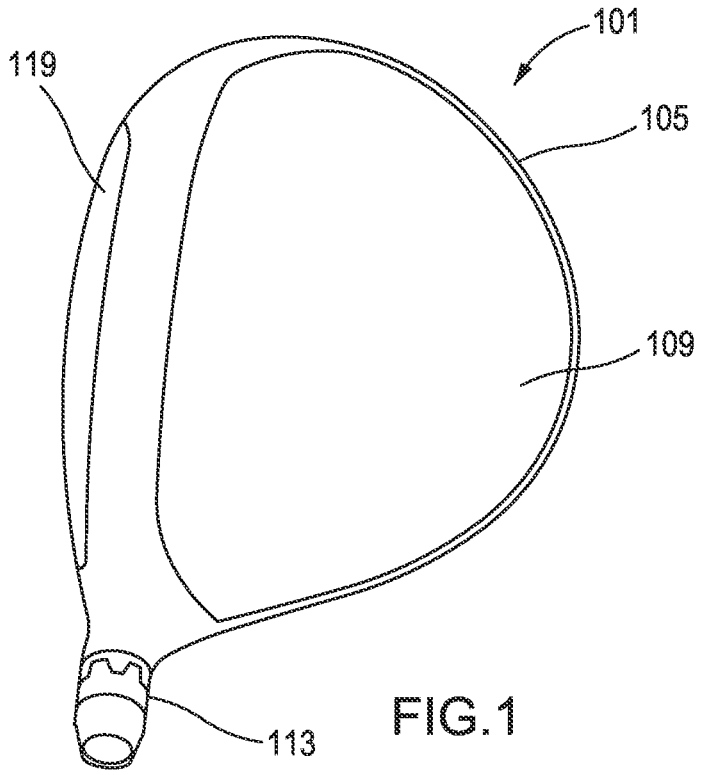
FIG. 1 shows a club head of the present invention.

FIG. 1 shows a club head 101 of the present invention. Club head 101 may be any hollow type of club head such as any wood-type or hybrid-type club head. Preferably, club head 101 is a driver. Generally, club head 101 will include a club head body 105 defining an overall shape of the head. Club head 101 will generally include a ball-striking face 119 and a hosel 113. Club head 101 also includes a removable component 109. Any suitable portion of club head 101 may be removable. For example, removable component 109 may be a panel of the sole, the entire sole, an aft body, a crown panel, or other. As shown in FIG. 1, removable panel 109 is a crown portion of club head 101. Club head 101 includes a mechanism to fasten removable panel 109 in place.

Figure 2:
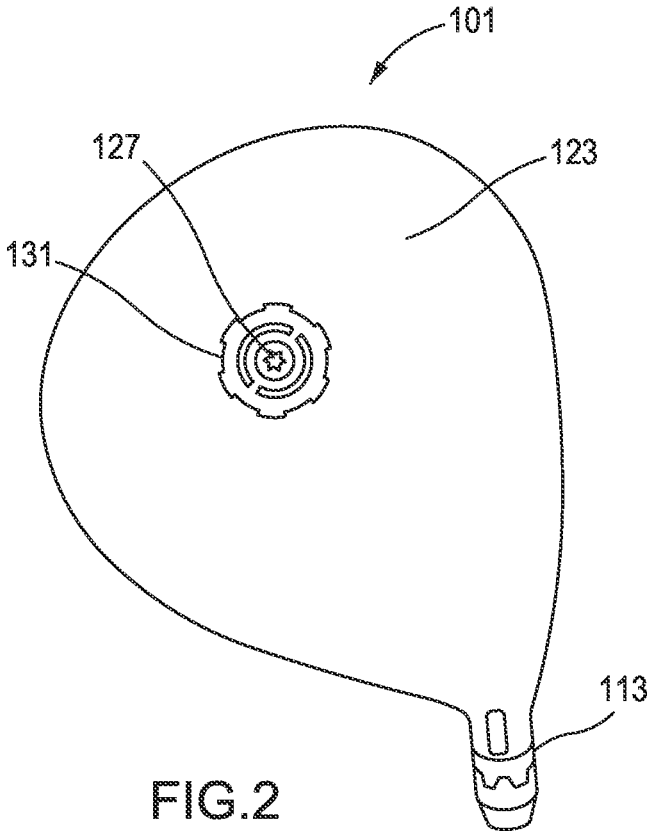
FIG. 2 shows a sole of a club head.

FIG. 2 shows a sole 123 of club head 101. Visible on sole 123 is fastening mechanism 131 having screw 127 fastened therein. Screw 127 (or any other suitable fastener such as a barbed post, a cotter pin, or other binder) is accessible from an exterior of club head 101. When screw 127 is in place, removable component 109 is held in place and club head 101 can be used in playing golf. A golfer can use a tool, such as a specialty tool with a custom tip, to unfasten screw 127 via a tool interface surface, such as a shaped recessed tool port. A golfer can unscrew screw 127 and release it, thereby releasing removable component 109.

Figure 3:
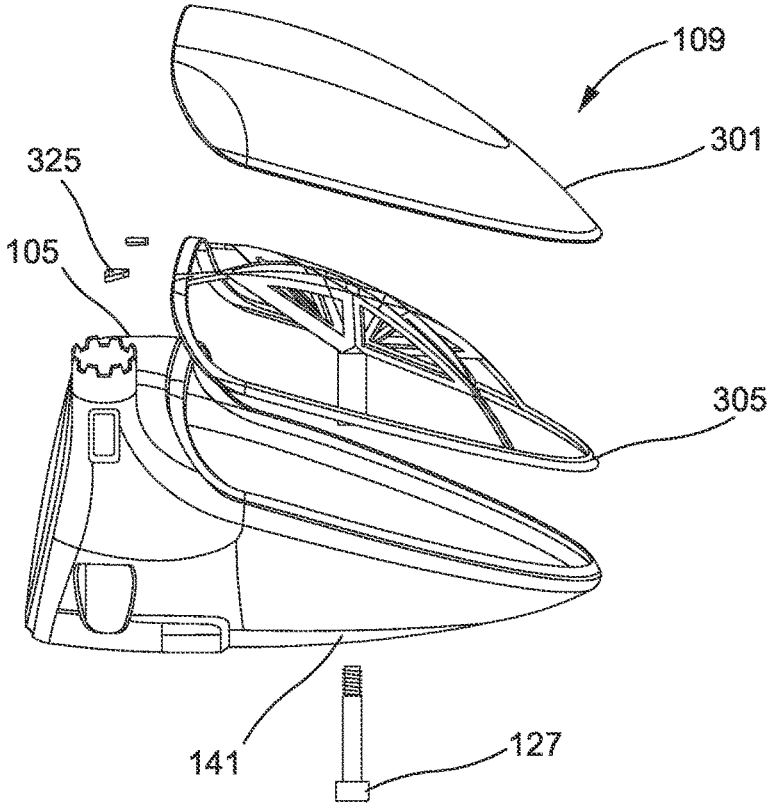
FIG. 3 depicts a club head with a removable component released.

FIG. 3 depicts a club head 101 of certain embodiments with a removable component 109 released from club head body 105. In the depicted embodiment, removable component 109 includes an exterior crown panel 301 and an interior crown frame 305. While depicted in FIG. 3 as separated, exterior crown panel 301 and interior crown frame 305 may preferably be fastened together as a single component, either by adhesive, co-molding, by being monolithically formed, or by other suitable means.

Removable component 109 includes a post 311 for receiving screw 127. Component 109 is also held against body 105 by bumpers 325 to prevent rattling and to contribute to the playability of club head 101. One insight of the invention relates to the need to distribute stresses about a perimeter of component 109 for club head 101 to be durable and effective for playing. Without being bound by any particular mechanism, it may be theorized that the impact of hitting a golf ball sends shock waves through a club head. Where a removable panel or component is a simple curved but featureless panel, it will deform differentially relative to an overall club head body. By inclusion of a frame 305 or equivalent set of trusses or buttresses providing radial support between attachment post 311 and crown panel 301, deformation of removable panel 109 is minimized and made congruent with any deformation of club head body 105. Thus during a hit, the overall club head responds as a holistic body and imparts energy to the ball in the form of a good coefficient of restitution—rather than dissipating energy through mismatched parts in the form of noise, cracking, or vibrations. Thus the depicted embodiments may provide unexpectedly good playing benefits in comparison to other structures.

Since club head 101 includes removable component 109, access is provided to an interior of club head 101. Since an interior of club head 101 is accessible, club head 101 can be modified or altered to affect the properties or shape of club head 101. In certain embodiments, club head 101 includes a system of adjustable mass within the interior. In some embodiments, a removable component alters a shape of a club head. For example, a removable component may include a portion of, or all of, the hosel. A first removable component can be replaced with a second removable component to change a club from having a straight-necked hosel to an offset hosel.

Figure 4:
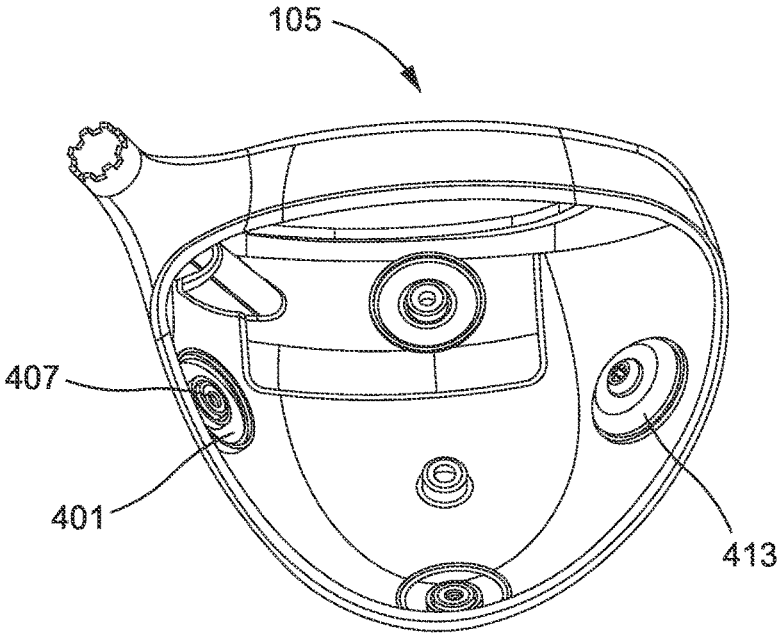
FIG. 4 illustrates an adjustable mass system according to embodiments of the invention.

FIG. 4 illustrates an adjustable mass system according to embodiments of the invention. As shown in FIG. 4, club head body 105 has removable component 109 removed revealing the interior. Club head 101 includes a set of weight mount points 401 therein. Each weight mount point 401 will typically include a mechanism 407 to which a removable weight may be affixed. Also shown in FIG. 4 is a removable weight 413 affixed to a weight mount point 401 in a toe-side area of the inside of the sole of club head 101.

Figure 5:
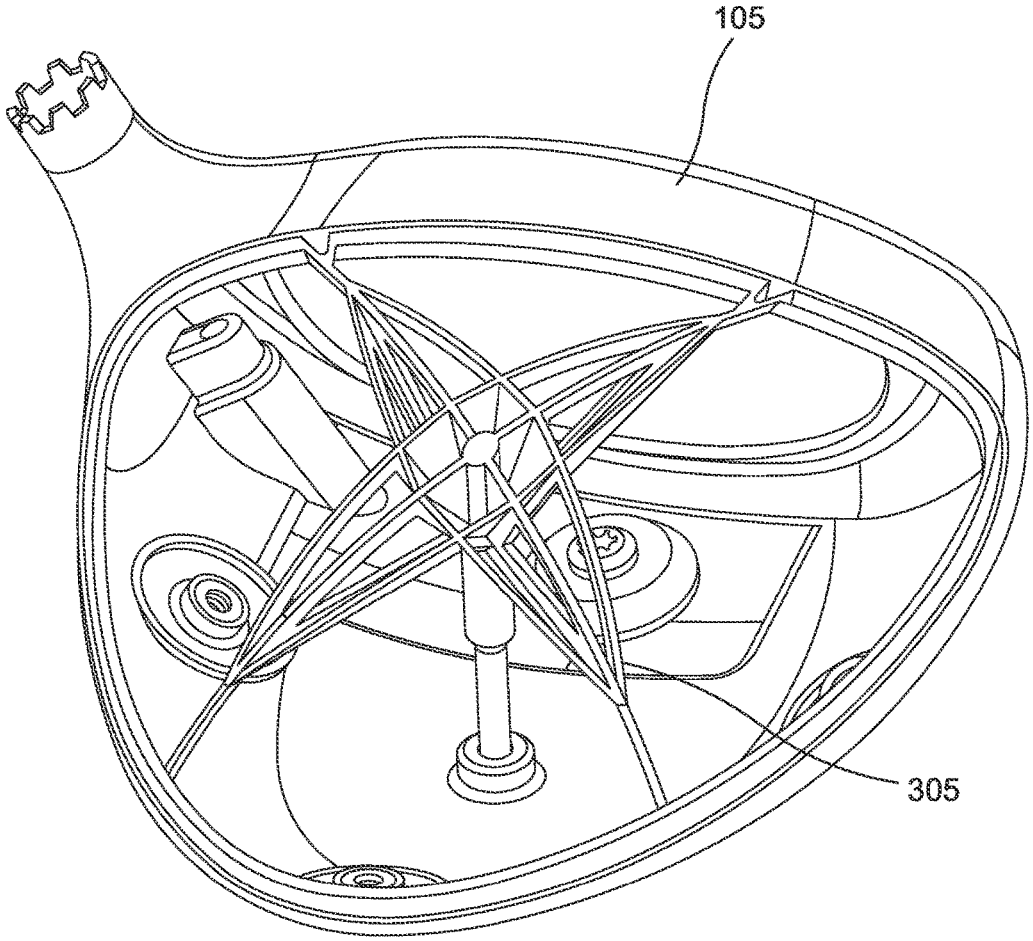
FIG. 5 gives a view into club head with its crown panel removed.

Weight mount points 401 may be distributed in any suitable locations within club head 101. In general, it may be preferable to include points 401 on an interior of the sole 123 of club head 101 as golfers may find benefit in keeping a club head center of gravity low. Club head 101 may include any number of mount points 401, such as, for example, 1, 2, 3, 4, 5, 6, 10 s, etc. In the depicted embodiment, club head 101 includes four mount points 401—one at each of face side, heel side, toe side, and aft side of the interior of sole 123. In some embodiments, club head 101 is made to have a certain mass such that when a certain number of removable weights 413 (e.g., one or two) are included, the overall mass of club head 101 is a desirable value FIG. 5 gives a view into club head 101 with its crown panel removed to illustrate the structure and orientation of frame 305. Frame 305 is shown as having four arms extending from post 311 towards a periphery of the frame and tapering to points towards the periphery. When screw 127 is tightened from a sole surface of club head 101, screw 127 pulls removable component 109 closed by tensile force. The tapering arms of frame 305 distribute the force across component 109, making for a playable club.

Figure 6:
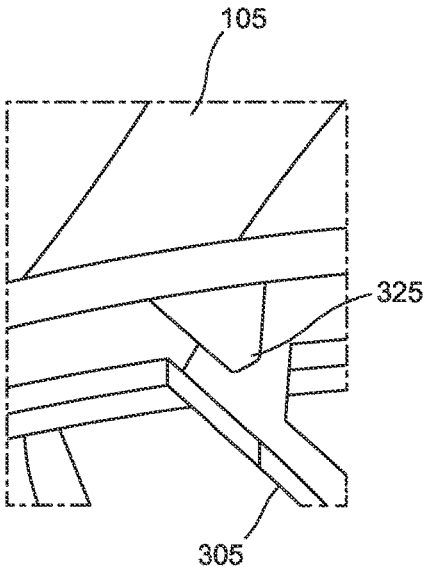
FIG. 6 shows a detail view of an inner periphery of a cutaway of club head body.

FIG. 6 shows a detail view of a point where an arm of frame 305 meets an inner periphery of the cutaway of club head body 105. Frame 305 may rest on bumpers 325, which may be provided by a viscoelastic material such as rubber or urethane. Inclusion of viscoelastic bumpers or a gasket (discussed in greater detail below) provide for desirable vibration dampening.

Figure 7:
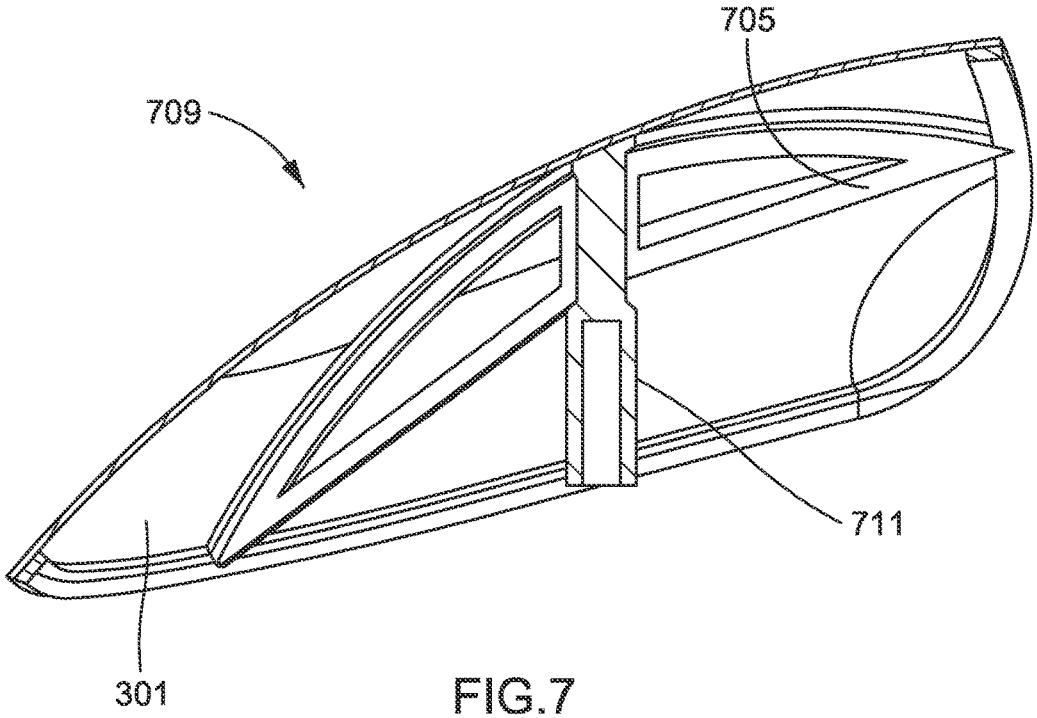
FIG. 7 depicts an alternative embodiment of removable component.

FIG. 7 depicts an alternative embodiment of removable component 709. Here, crown panel 301 sits on a frame 705 that has four substantially flat, vertical truss members extending from post 711 to a periphery of frame 705 (only two truss members are shown as frame 705 is drawn in cutaway view). Each of the four truss members substantially defines a triangle with a curved, crown-side edge, radiating away from the central post 711. Central post 711 receives assembly screw 127. Each of the radiating arms define open triangles to promote light weight. Central post 711 extends beneath the radiating arms.

Aspects of the invention relate to a removable component that provide the desirable features and good playing properties described here. For example, a removable component may include (e.g., as well as or instead of a truss) a heightened mass around the screw receptacle in which the thickness is tapered toward the other portion of the crown. In some embodiments, an internal truss structure is in a circular formation around the screw receptacle. The invention includes any structure that provides a solid consistent compression of the crown with the body.

Figure 8:
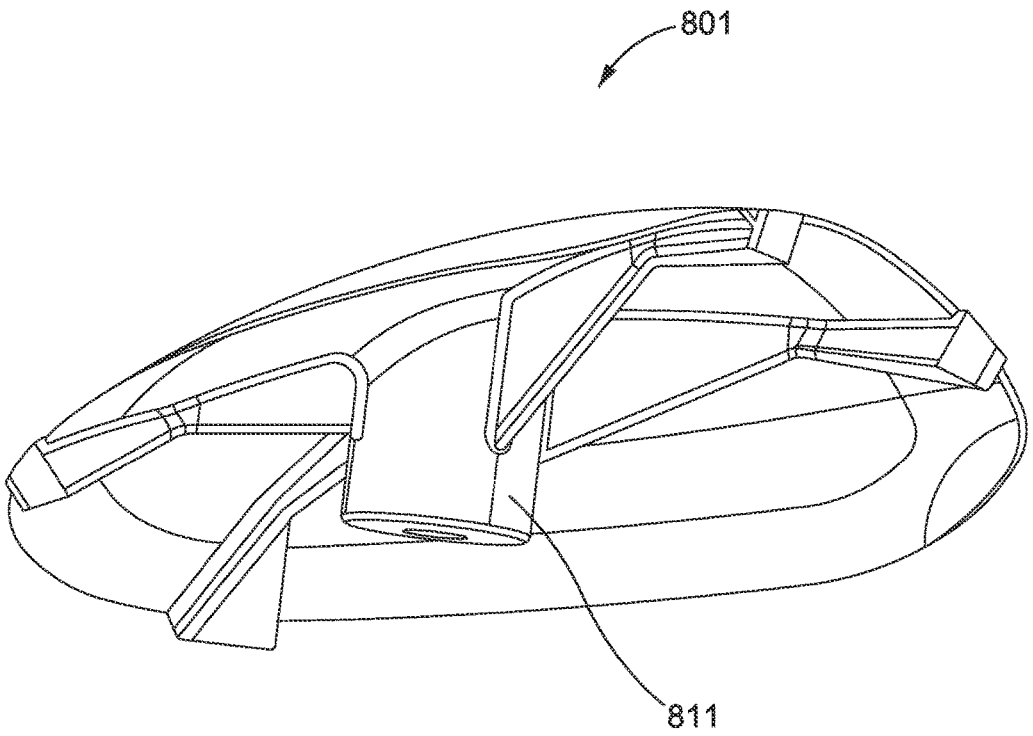
FIG. 8 presents an alternative structure for a removable component.

FIG. 8 presents an alternative structure for a removable component 801 for use with club head body 105. Here, each of the radiating arms includes a shape similar to two joined triangles, not open, radiating from thick central post 811. Removable component 801 as shown in FIG. 8 may be monolithically formed (i.e., not have a separate frame and crown panel). This may be preferred for cost and simplicity.

Figure 9:
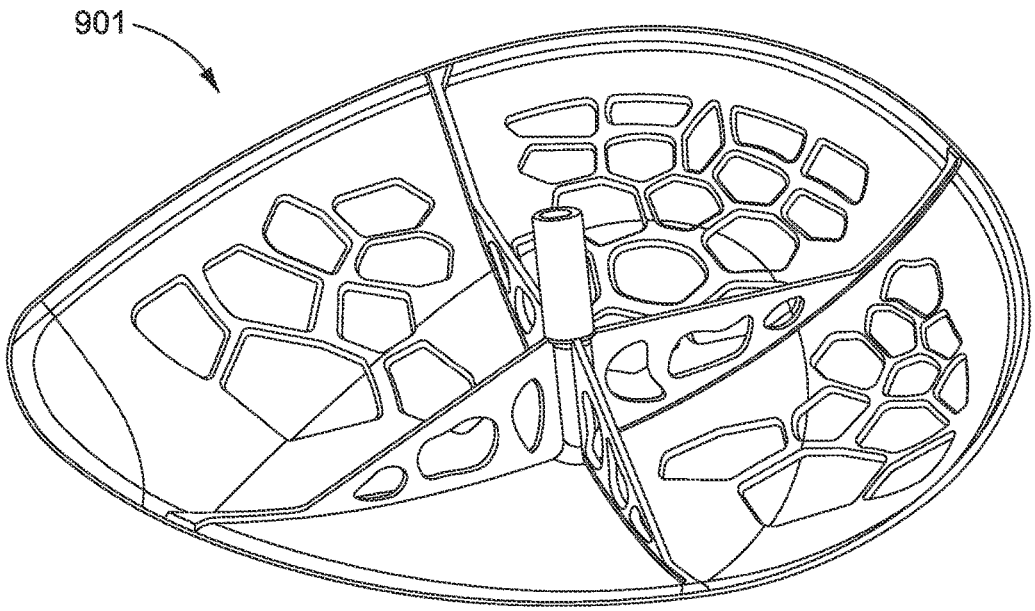
FIG. 9 illustrates a removable crown according to certain embodiments.

FIG. 9 illustrates a removable crown 901 according to certain embodiments. Removable crown 901 is generally characterized by a central post for receiving assembly screw 127 and a set of radiating truss members. Additionally, crown 901 has a pattern of cutaway portions with apparently irregular borders. It may be found that including a network of apparently irregular cutaways promotes weight savings and strength. On the radiating trusses, the irregular border cutaways are cut through the truss members to create apertures. On the crown panel itself, the irregular border cutaways are cut into the inside surface but not all the way through, so that the exterior surface remains intact.

Figure 10:
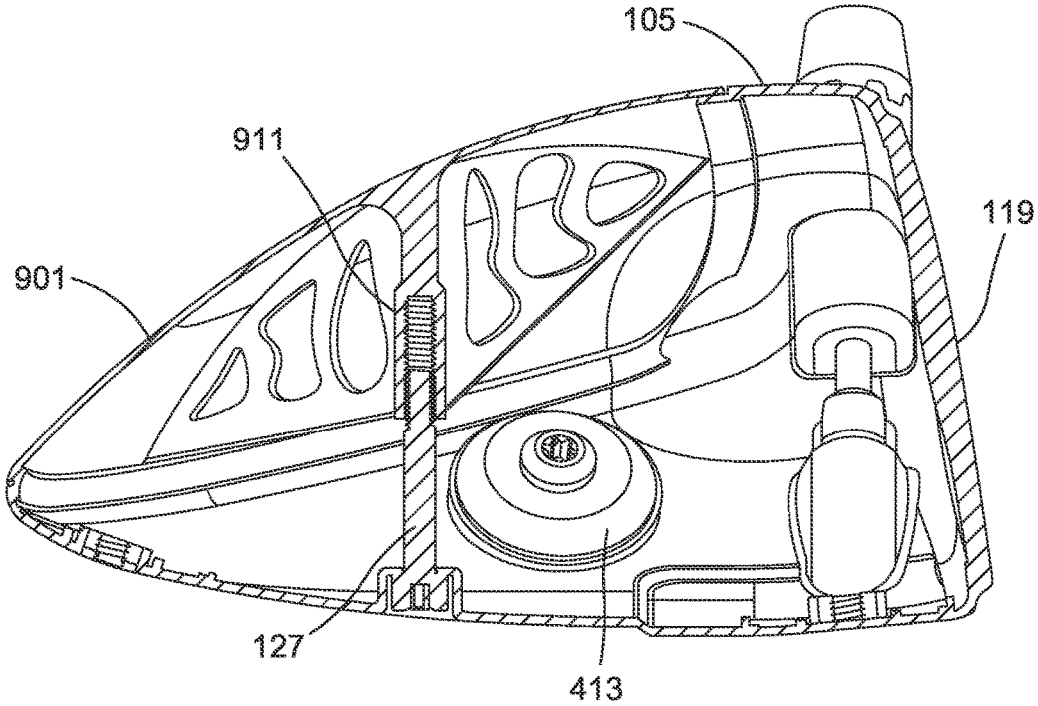
FIG. 10 shows a club head with a removable crown.

FIG. 10 shows a club head 101 of the present invention fitted with a removable crown 901. Assembly screw 127 extends through the sole of the club head and engages with post 911 of removable crown 901. This fastens crown 901 to main club head body 105. The radiating trusses distribute impact energy when ball striking face 119 hits a golf ball, so that club head 101 maintains an overall cohesive form and good coefficient of restitution, imparting high energy to the golf ball. A removable weight 413 can be seen mounted within club head 101 in FIG. 10. Additionally, it can be seen that removable crown 901 meets club head body 105 at a seam defined by a flange portion of club head body 105 extending under removable crown 901. This seam can be closed with a gasket, sealed with an adhesive, held together primarily by pressure from screw 127, or held in any other suitable fashion.

FIGS. 11-17 depict embodiments of the mounting edge (i.e., the outer periphery) for a removable component 109 of a club head of the present invention.

Figure 11:
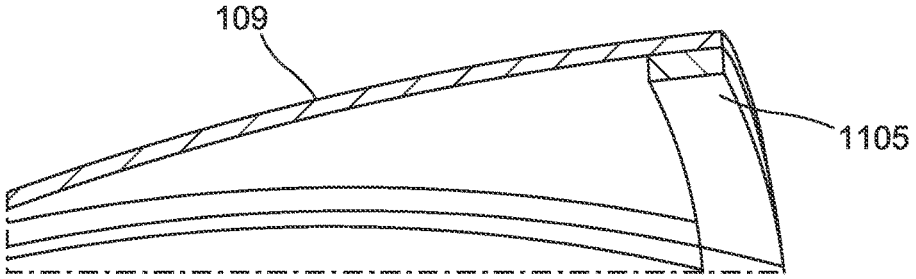
FIG. 11 depicts a removable component with a gasket.
Figure 12:
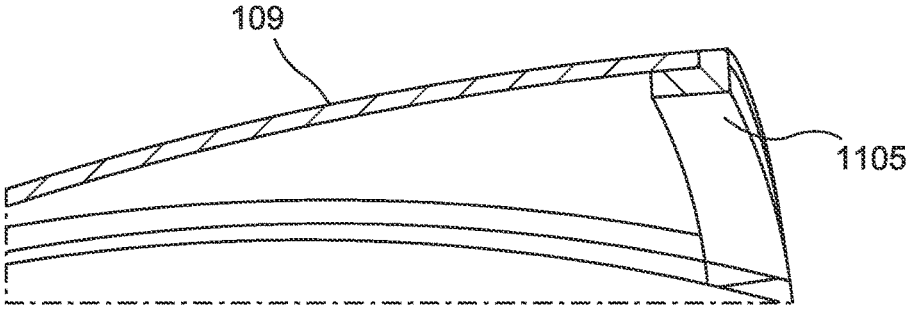
FIG. 12 depicts an embodiment in which gasket has an L shaped cross-section.

FIG. 11 depicts a removable component with a gasket 1105 extending around an outer periphery of the component. Gasket 1105 is preferably a viscoelastic material to prevent rattling and to distribute stresses uniformly FIG. 12 depicts an embodiment in which gasket 1106 has an L shaped cross-section and lies interposed between removable component 109 and main club head body 105. It may be preferable to include this embodiment where removable component 109 and main club head body 105 are formed of unlike metals to mitigate galvanic corrosion between the metals. Additionally, the pliable form of gasket 1105 aids in forming a water-tight seal between removable component 109 and club head body 105.

Another useful benefit of a gasket relates to production economy. A gasket may be included to hide deviations in tolerance between two edges and thus to create a solid visual appearance of a seal. This allows for manufacturing to meet a slightly relaxed fit tolerance, which can provide considerable savings in time and cost during production.

Figure 13:
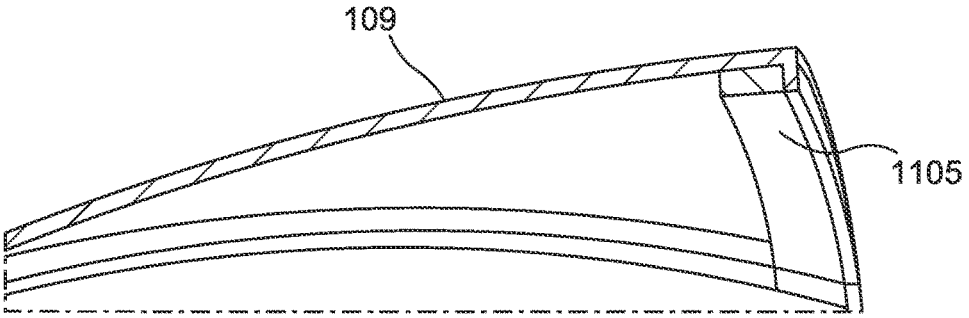
FIG. 13 shows a removable component with an L-shaped edge.

FIG. 13 shows a removable component 109 with an L-shaped edge enclosing gasket 1105. This allows club head 101 to have the benefit of gasket 1105 in terms of excluding moisture and dampening shock and vibration but allows gasket 1105 to be concealed from an exterior of club head 101. Concealing gasket 1105 may provide useful benefits in manufacturing as tolerances are more lenient and a uniform appearance of gasket 1105 may not be required, since having a non-uniform gasket 1105 will not interfere with an exterior surface of club head 101 and thus not interfere with aerodynamics (e.g., in the embodiment depicted in FIG. 13).

Figure 14:
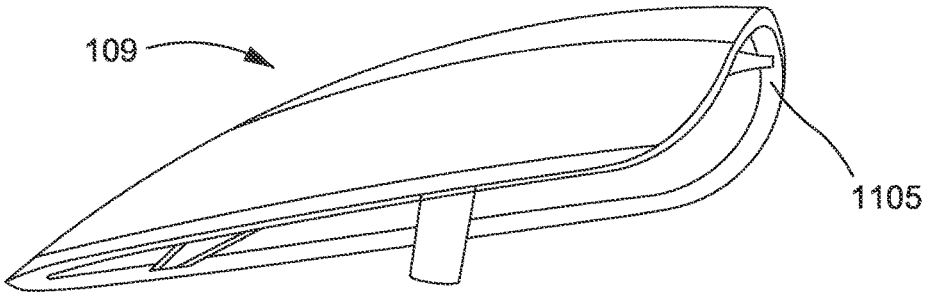
FIG. 14 shows a two-layer gasket.

FIG. 14 illustrates use of a two layer gasket.

Figure 15:
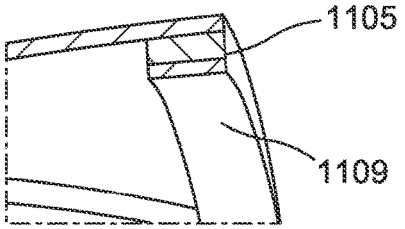
FIG. 15 shows a close-up detail view of a two layer gasket.

FIG. 15 shows a close-up detail view of the two layer gasket of FIG. 14. Here, gasket 1105 is interposed between removable component 109 and interface layer 109. Interface layer 1109 may be of a softer material than gasket 1105 to improve the fit between removable component 109 and club head body 105.

Figure 16:
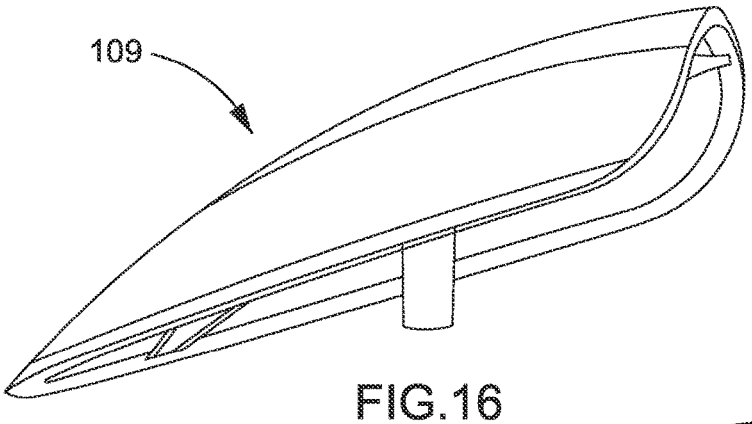
FIG. 16 shows a gasket that uses an O-ring.

FIG. 16 shows a gasket that uses an O-ring. Here, gasket 1105 is fitted with O-ring 1113 that extends around an outer periphery of removable component 109.

Figure 17:
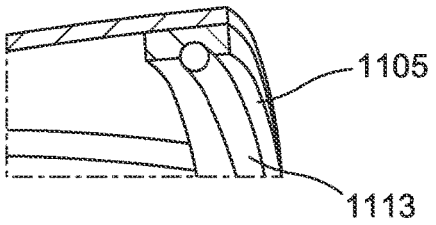
FIG. 17 shows a detail view of the gasket and O-ring.

FIG. 17 shows a detail view of the gasket 1105 and O-ring 1113. O-ring 1113 protrudes from gasket 1105 and is itself compressible, which ensures a good fit between removable component 109 and club head body 105. Thus the depicted embodiment may provide for excellent weatherproofing. Also, O-ring 1113 may be found to be an easily replaceable component, thus allowing a club head 101 with a removable component 109 to last a long time and since deterioration of an O-ring does not require that club head 101 be taken out of service.

Golf club head 101 has a removable component 109, which provides access to an interior of the club head. This allows devices or mechanisms to be included inside of golf club head 101. Any suitable device may be included in club head 101 including, for example, an electronic device such as a shot detector, computer, GPS unit, battery pack, etc. Additionally, club head 101 can include moveable or adjustable mechanisms so that mass properties of a club head can be adjusted. In some embodiments, club head 101 includes one or a set of removable weights 413.

Figure 18:
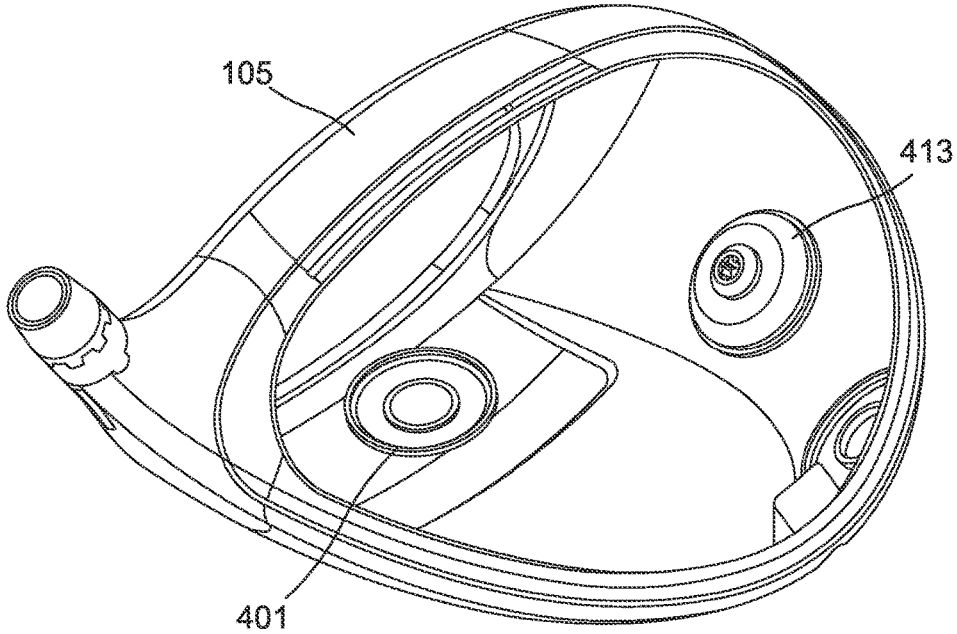
FIG. 18 illustrates a club head body with a removable component removed.

FIG. 18 illustrates a club head body 105 with removable component 109 removed revealing the interior. Club head 101 includes a set of weight mount points 401 therein. Weight mount ports may be arranged in any suitable locations in club head 101. In some embodiments, a weight mount port 401 is included in one or more of the leading area of the inside sole surface, the trailing area of the inside sole surface, a toe side of the inside sole surface, and a heel side of the inside sole surface. In FIG. 18, weight mount point 401 on the toe side of the inside sole surface is shown as having a removable weight 413 mounted on it.

In some embodiments, a club head of the invention includes a non-threaded adjustment system that uses Velcro or an adhesive to provide a highly-adjustable mass distribution system. With a non-threaded adjustment system, mass can be added in any continuous or non-discrete arrangement and the mass-positioning possibilities are, in fact, endless.

In certain embodiments, the adjustment system uses other means such as channels, prongs, spikes, edges, etc., and attachable material such as silicone caulk or other sticky or gummy material that can be pressed in. For example, an inner surface of the club head can include a solid (e.g., metal, carbon fiber, etc.) honeycomb mesh frame and material such as clay, caulk, compound, etc., can be pressed into the holes in a desired pattern. The adjustment system can include snap-together or snap-in weights or any other suitable mechanism.

Figure 19:
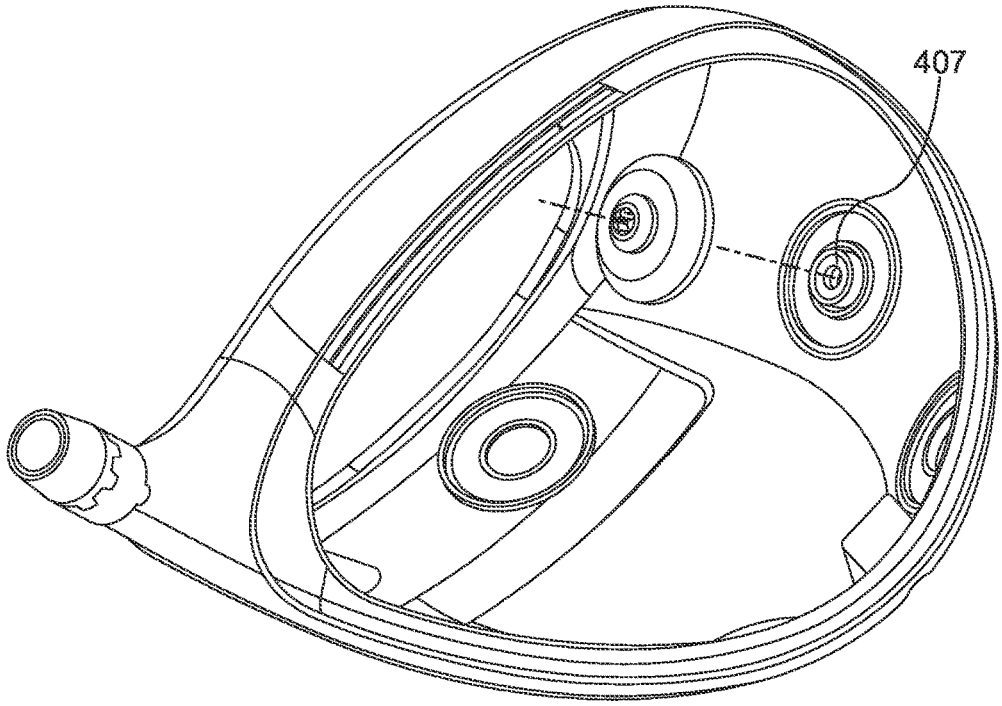
FIG. 19 shows a removable weight and a weight mount point.

FIG. 19 illustrates a relationship between removable weight 413 and weight mount port 401. Weight mount point 401 includes a mounting mechanism—here, a threaded socket 407. Threaded socket 407 may be fixed into, or created within, weight mount point 401 by any suitable mechanism, such as welding, glue, press-fit, or others. In some embodiments, weight ports are cast as part of the surrounding component and threads are then tapped in. In certain embodiments, the area of the club head defines a casting (e.g., with Ti) and threads are then machined in.

Removable weight 413 includes a corresponding threaded post (and may also include a gasket, washer, or other mechanisms, to mitigate vibration and aid in good fit). Removable weight 413 can thus be fixed into, or removed from, an interior of golf club head 101 via a threaded interface. Removable weight 413 preferably includes a tool interface on an exterior surface. FIGS. 20-25 illustrate constructions of removable weights 413 according to embodiments of the invention.

Figure 20:
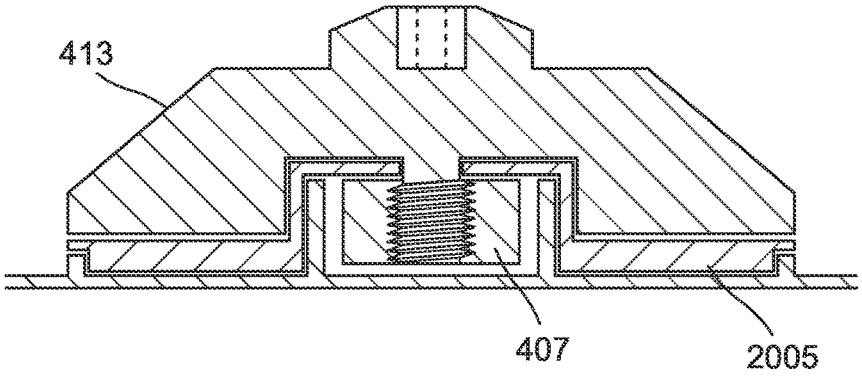
FIG. 20 illustrates a two-piece construction for removable weight.

FIG. 20 illustrates a two-piece construction for removable weight 413. Removable weight 413 sits in mount point 401, which may be, for example, cast in titanium (e.g., where a portion of or all of a sole 123 of club head 101 is titanium). Removable weight 413 may be made of a dense material such as tungsten alloy. Disposed between the weight and the mount point is a polymer gasket 2005. In some embodiments, polymer gasket 2005 is adhered to the bottom surface of the tungsten alloy removable weight 413. Inside of the casting for the mount point is a threaded insert 407 (e.g., adhered to the Ti casting) or threads (e.g., tapped in) to receive threaded post of removable weight 413. Polymer gasket 2005 may preferably include both horizontal walls as well as vertical walls surrounding the Ti casting of mount point 401 to aid in dissipating shear stresses associated with a ball strike.

Figure 21:
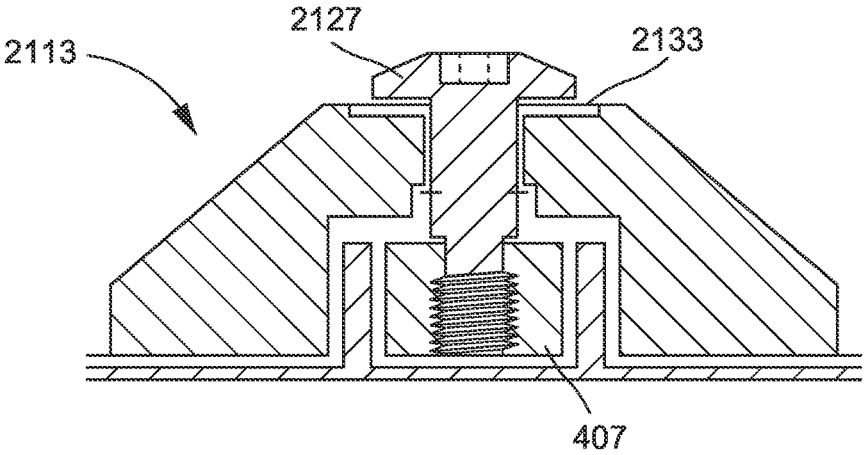
FIG. 21 shows an embodiment in which a removable weight includes a screw.

FIG. 21 shows an alternative embodiment in which a removable weight 2113 includes a screw member 2127 extending through the weight body. A washer 2133 may be disposed between the head of the screw and the weight body. Optionally, a retaining ring may be included. Screw member 2127 mates with threaded insert 407.

Figure 22:
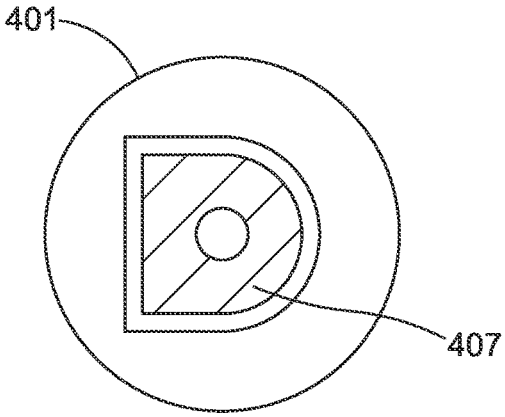
FIG. 22 depicts a threaded insert and a casting of a mount point.

FIG. 22 depicts a relationship between threaded insert 407 and the casting of mount point 401. By including a flat edge, a spline, a corner, or an irregularity, threaded insert can be prevented from rotating within mount point 401. Threaded insert may have any suitable shape such as rectangle, star-shaped, hexagon, etc.

Figure 23:
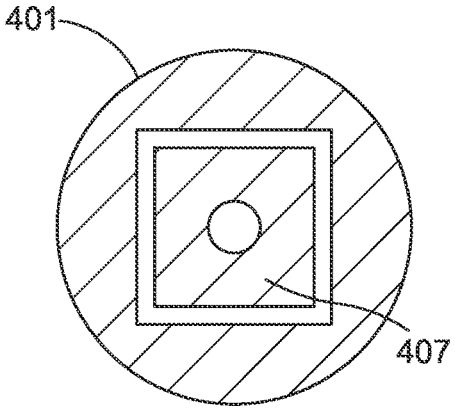
FIG. 23 illustrates a threaded insert with a square cross-section.

FIG. 23 illustrates an embodiment in which threaded insert 407 has a square cross-sectional shape to prevent rotation within mount point 401.

Figure 24:
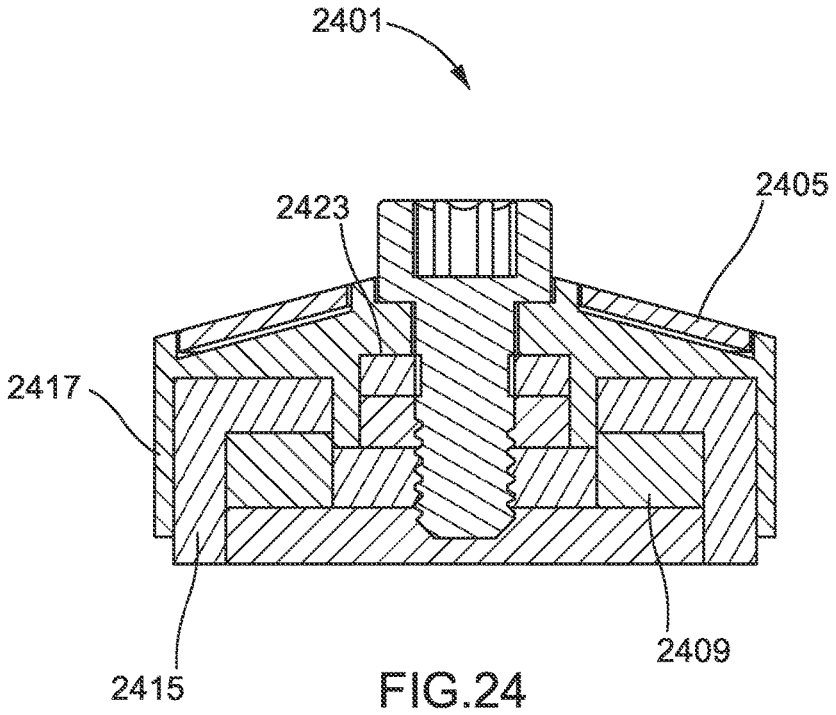
FIG. 24 shows an embodiment for a removable weight.

FIG. 24 shows an embodiment for a removable weight 2401. Cover 2417 defines an overall shape of removable weight 2401. Cover 2417 houses insert 2415 that provides mass. Insert 2415 can be any material of a desired density and may be, for example, tungsten-loaded rubber.

In some embodiments, insert 2415 further houses a ring member 2409 for additional weighting. Ring member 2409 may be varied to give weight 2401 a desired mass. For example, ring member 2409 may be a steel ring selected from a set of varying thickness, or ring member 2409 may be made from any other suitable material. Cover 2417 may sport medallion 2405. By including a separate medallion 2405, different information may be added to weight 2401 after its intended mass is set (e.g., by inserting one or a plurality of ring member 2409). Thus, a plurality of cover 2417 can be manufactured uniformly and used to create a variety of different weights 2401. Different weights 2401 can include different masses through the variation of ring member 2409 and the different masses can be communicated to the user by affixing a different medallion 2405 to the cover 2417.

In certain embodiments, different weight members have different masses by having differing densities in their constituent materials. For example, a weight member body or screw may be made with metals or other materials of different densities (e.g., some tungsten screws, some aluminum screws, etc.)

Removable weight 2401 includes a screw extending therethrough for coupling to threaded insert 407. In some embodiments, removable weight 2401 will include a retaining washer 2423 (e.g., rubber) to hold the screw inside of the weight.

Figure 25:
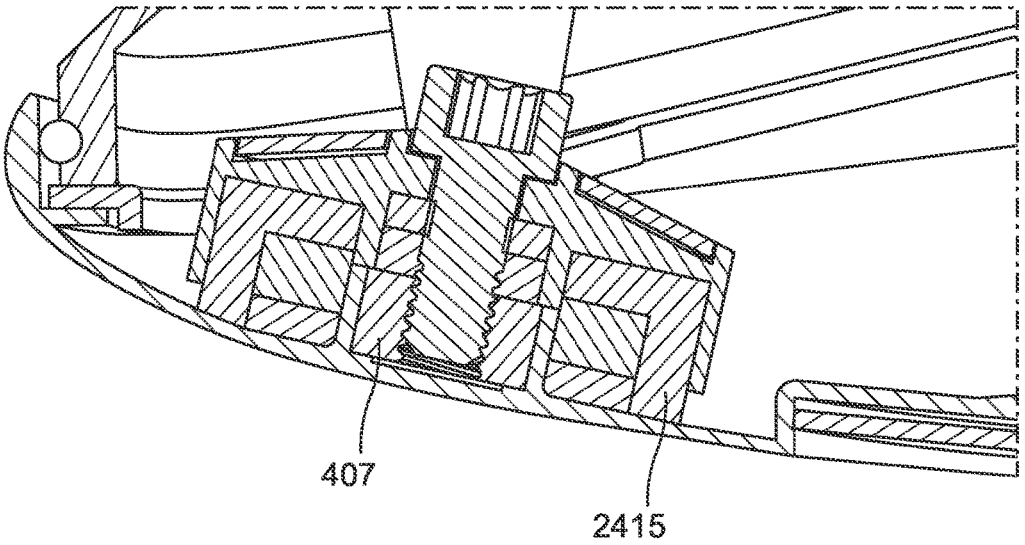
FIG. 25 shows removable weight installed in club head.

FIG. 25 shows removable weight 2401 installed in club head 101. Weight 2401 is mounted to point 401 on an inside surface of the sole 123 of club head 101 via threaded insert 407 fixed therein (e.g., by glue). In the depicted embodiment, it will be noted that the cover 2417 defines an inner cylinder member that sits on the extended cylindrical wall of mount point 401. It may be found preferable to have weight 2401 bottom out, when being screwed into place, by having cover 2417 push against the protruding portion of mount point 401, as depicted. Since insert 2415 is preferably a pliable material such as rubber, the lowermost surface of insert 2415 deforms to conform to the curved inner surface of sole 123 thereby stabilizing removable weight 2401 inside of club head 101.

Since club head 101 can be opened and includes removable or repositionable weights, mass properties of the club head can be adjusted. In some embodiments, club head 101 can be opened by a golfer and re-closed (e.g., as many times as he or she would like). In certain embodiments, club head 101 is open initially, and is fitted to a golfer one time by adjusting the positions of the weights, and then closed and can optionally be sealed shut (e.g., by adhesive) once the club head is fitted to the golfer. Additionally, the club head may be provided with information to guide the positioning of weights. Information may be provided in the form of a color scheme, or labels on the weight mount points 401 or with an informational pamphlet, web page, computer program, or smart phone app that is made available to guide a golfer in locating weights.

Figure 26:
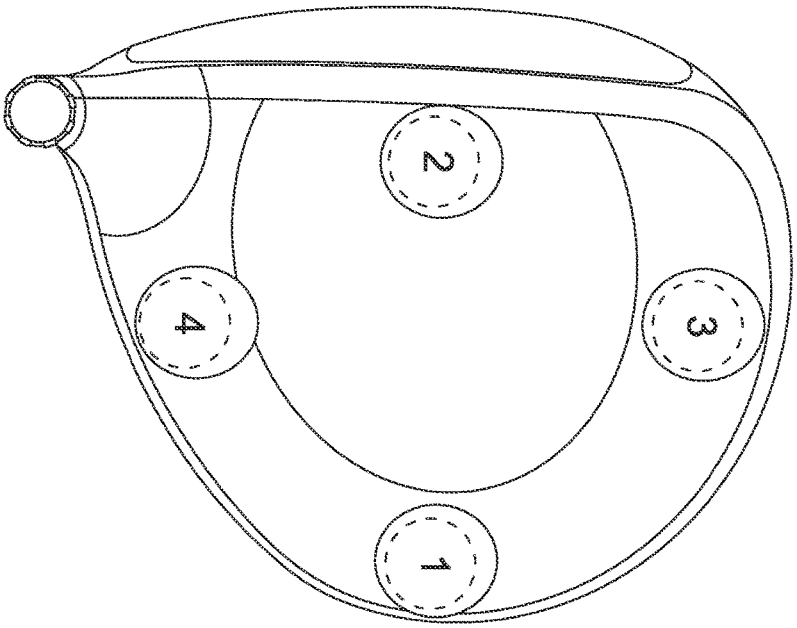
FIG. 26 gives an informational guide.

FIG. 26 illustrates a way in which an interior of club head or an informational guide may be labelled to guide a golfer. In FIG. 26, the dashed circles and the numerals correspond to the dashed lines and numerals shown in FIG. 27.

Figure 27:
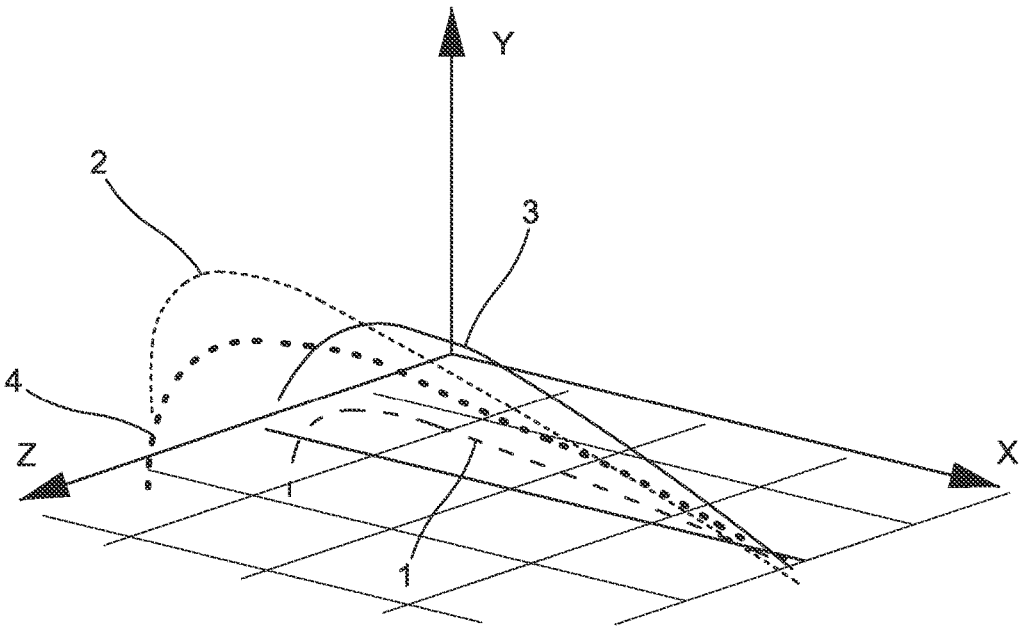
FIG. 27 shows an informational display that may guide the location of weights.

FIG. 27 shows an informational display that may be used to guide a golfer in locating weights inside of club head 101. As can be seen by considering FIGS. 26 and 27 together, it will be noted that toe-side mount point 3 can aid in guiding the ball to the right and thus can correct a hook. Point 4 can guide the ball to the left and thus aid in correcting a slice. Point 1 can move a club head center of gravity back and increase MOI, making a club head more forgiving to off-center hits. Point 2 can create more drive, allowing a skilled golfer to obtain great distance with the club head.

An inside of a club head can include an informational display or other indicia on a surface or included (e.g., as a card, pamphlet, etc.) and can be printed, painted, electronic, etc. For example, a club head could include an LED or LCD screen that provides information such as a shot-tracking information, weighting suggestions, hit pattern history, etc. A club head could include slogans, inspirational phrases, initials. Information could be provided as a customizable feature, e.g., made-to-order for a golfer. For example, a golfer could opt to have a club head include a decal or a logo from a favorite sports team or an engraving or motto, etc. In some embodiments, a club head of the present invention is sold with one or a set of removable weights and the golfer is given information to guide the selection of location for the weights. For example, a printed card or pamphlet may be included with the packaging of the golf club. Alternatively, the golfer may be directed to a web page or computer program. A golfer may be provided with a single weight that, when taken with the mass of the club head, provides a desired overall weight (e.g., 195 grams, or 205 grams, etc.). In some embodiments, a golfer is provided with two (or more) weights that add up to the amount of mass necessary to provide the desired overall weight. For example, club head 101 may include a 1 gram weight and a 10 gram weight. Golfers can create a "draw bias" by putting the 10-gram weight in the heel (position 4 in FIG. 16) and the 1-gram weight in the toe (position 3). They can create a "neutral bias" by swapping the weights, putting the 10-gram weight in the toe and the 1-gram weight in the heel.

Preferably, golf club head 101 is offered in a kit that includes the removable weights and one or more tools for adjusting the club head. For example, assembly screw 127 and the screw of a repositionable weight can include the same size tool interface, and a single tool can be provided.

The invention further provides additional embodiments of a golf club with a removable component that creates a playable, watertight club head when assembled. FIGS. 26-31 illustrate an embodiment that uses an O-ring and a gasket. FIGS. 32-39 show the use of an intermediate body piece.

Figure 28:
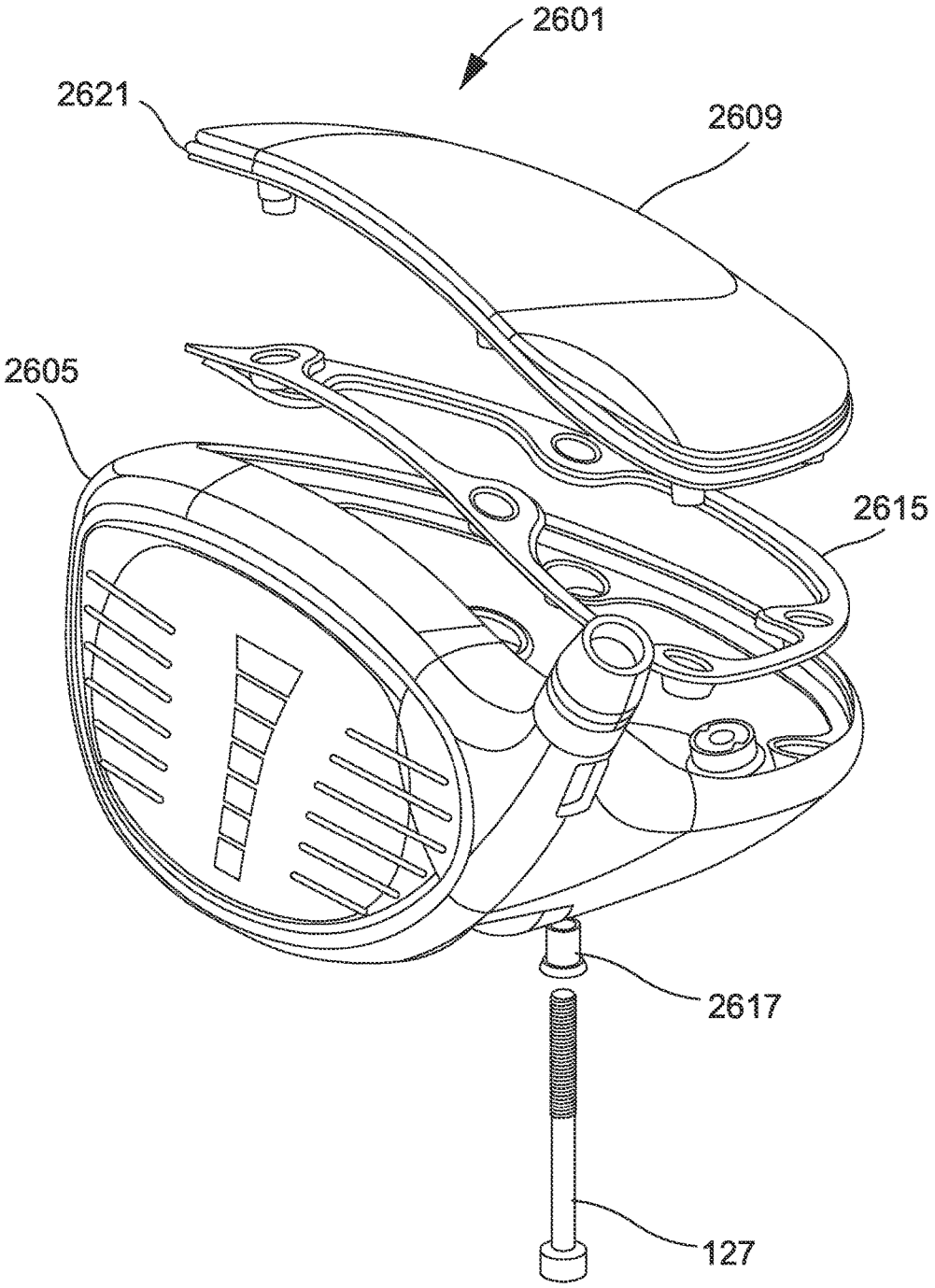
FIG. 28 shows an exploded view of a golf club head.

FIG. 28 shows an exploded view of a golf club head 2601 with a removable component 2609. Component 2609 sits on gasket 2615 which may be glued to the club head body 2605 (e.g., titanium). Assembly screw 127 is seated in club head body 2605 through the use of a shoulder member 2617 (e.g., Ti, Al, PTFE, carbon fiber, etc.) Screw 127 may be held in the place through a rubber washer or similar mechanism. O-ring 2621 extends around a perimeter of removable crown 2609.

Figure 29:
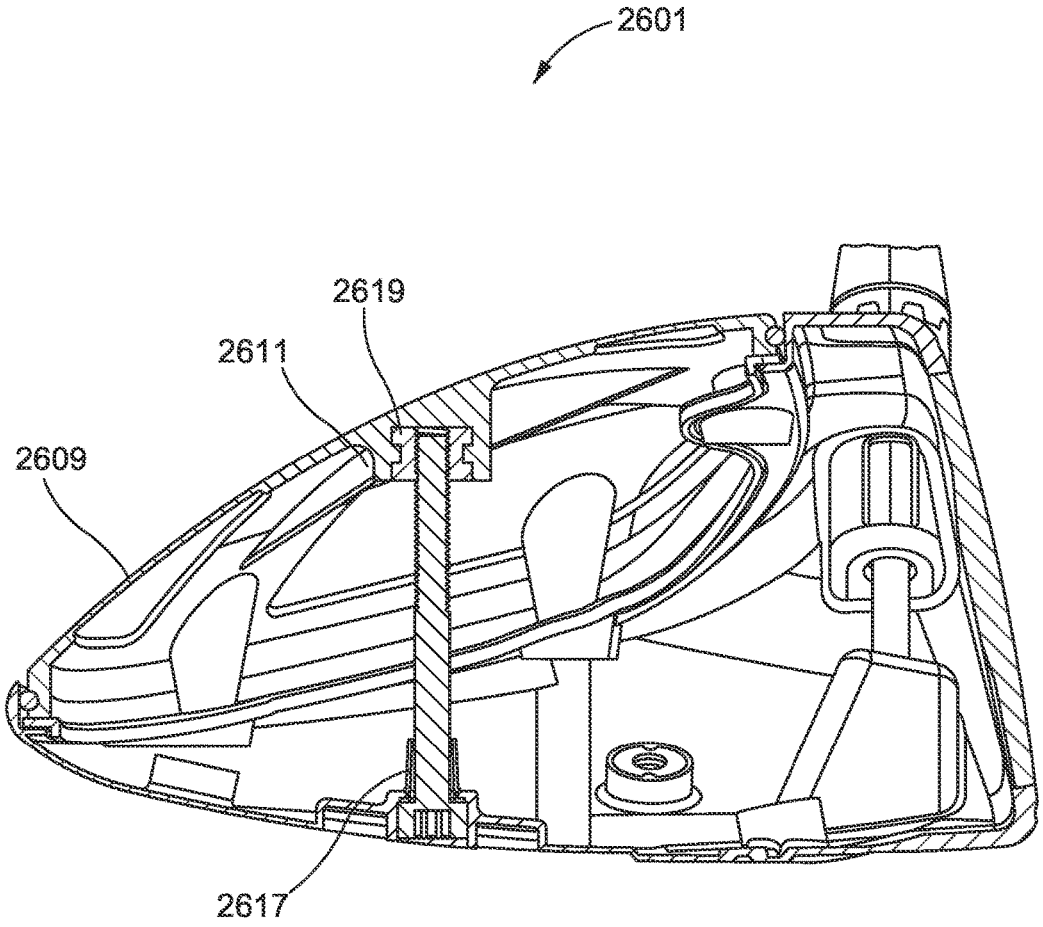
FIG. 29 shows a cutaway view through club head.

FIG. 29 shows a cutaway view through club head 2601. It can be seen that center post 2611 extending down from removable component 2609 is fitted with a threaded insert 2619. This may be, for example, an aluminum insert co-molded into crown 2609. Screw 127 extends from screw shoulder 2617 to threaded insert 2619 to fasten removable component 2609 into place.

Figure 30:
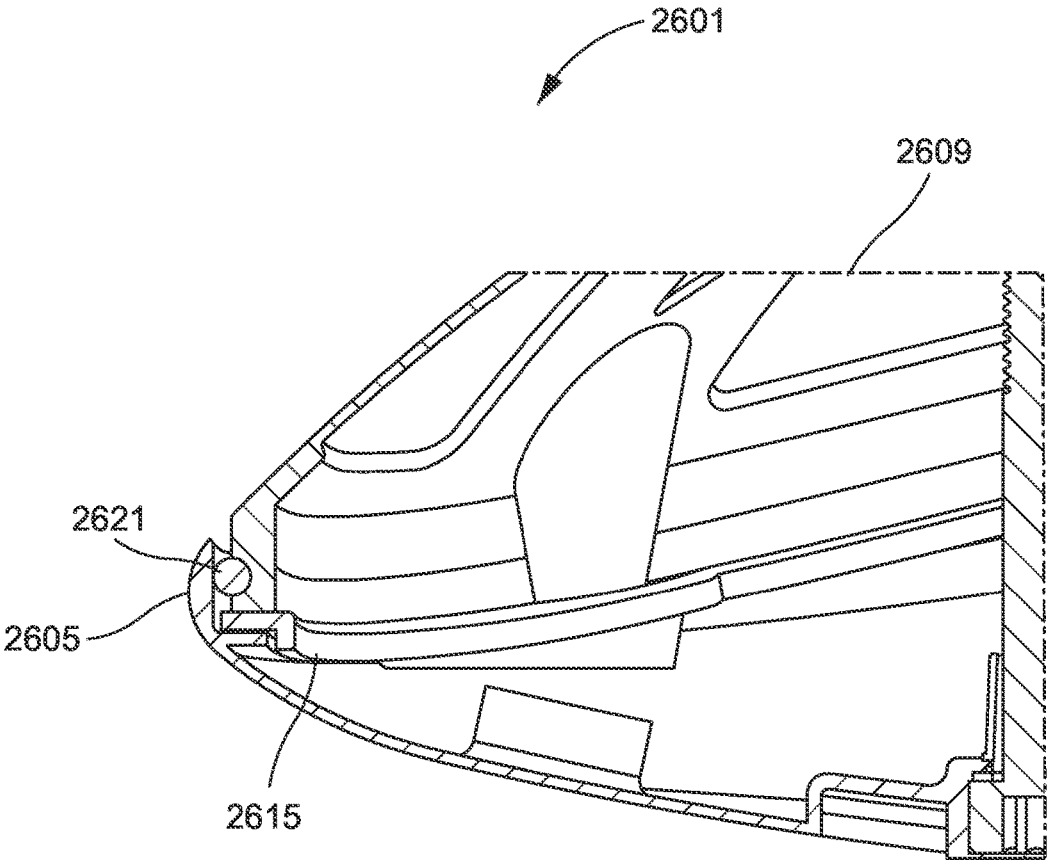
FIG. 30 illustrate the use of O-ring to create a seal.

FIG. 30 illustrate the use of O-ring 2621 to create a seal between removable crown 2609 and club head body 2605 when the crown if fastened into place. Gasket 2615 helps seat crown 2609 in the correct position and prevents vibration or rattle between the parts. O-ring 2621 creates a moisture barrier and also can be replaced so that club head 2601 provides enduring utility.

Figure 31:
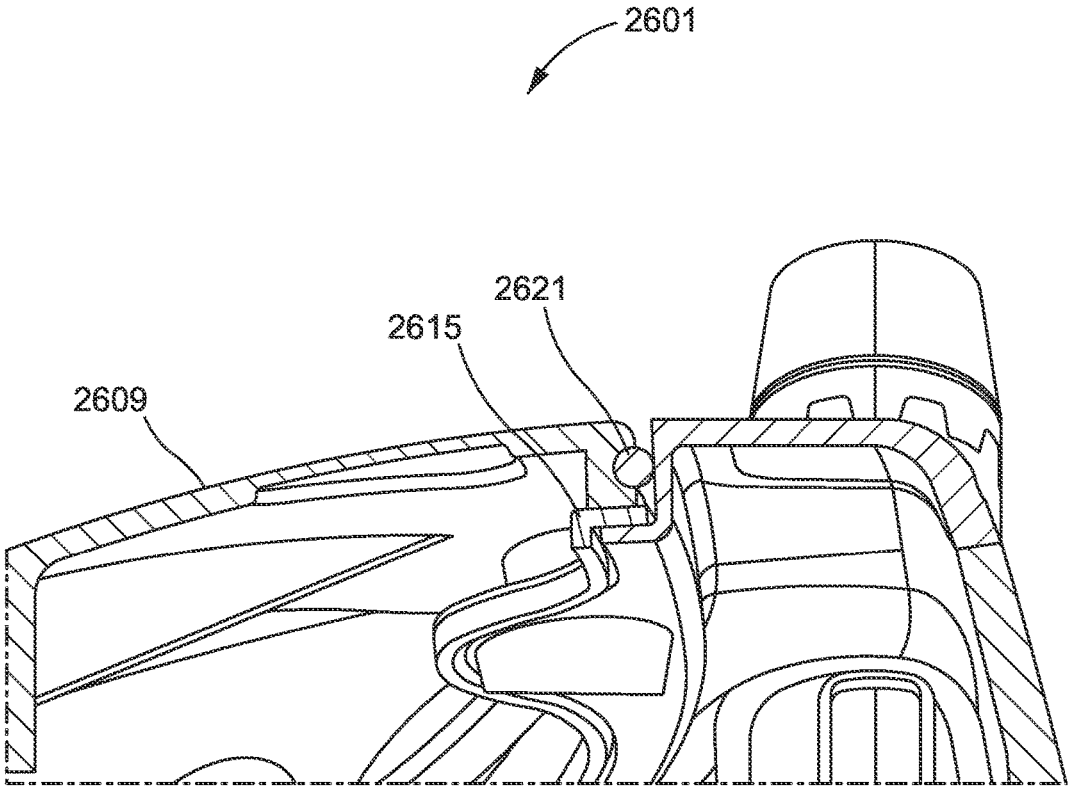
FIG. 31 shows a connection between crown and a club head body.

FIG. 31 shows a leading edge of connection between crown 2609 and club head body 2605. Crown 2609 seats on gasket 2615 and O-ring 2621 provides a seal.

Figure 32:
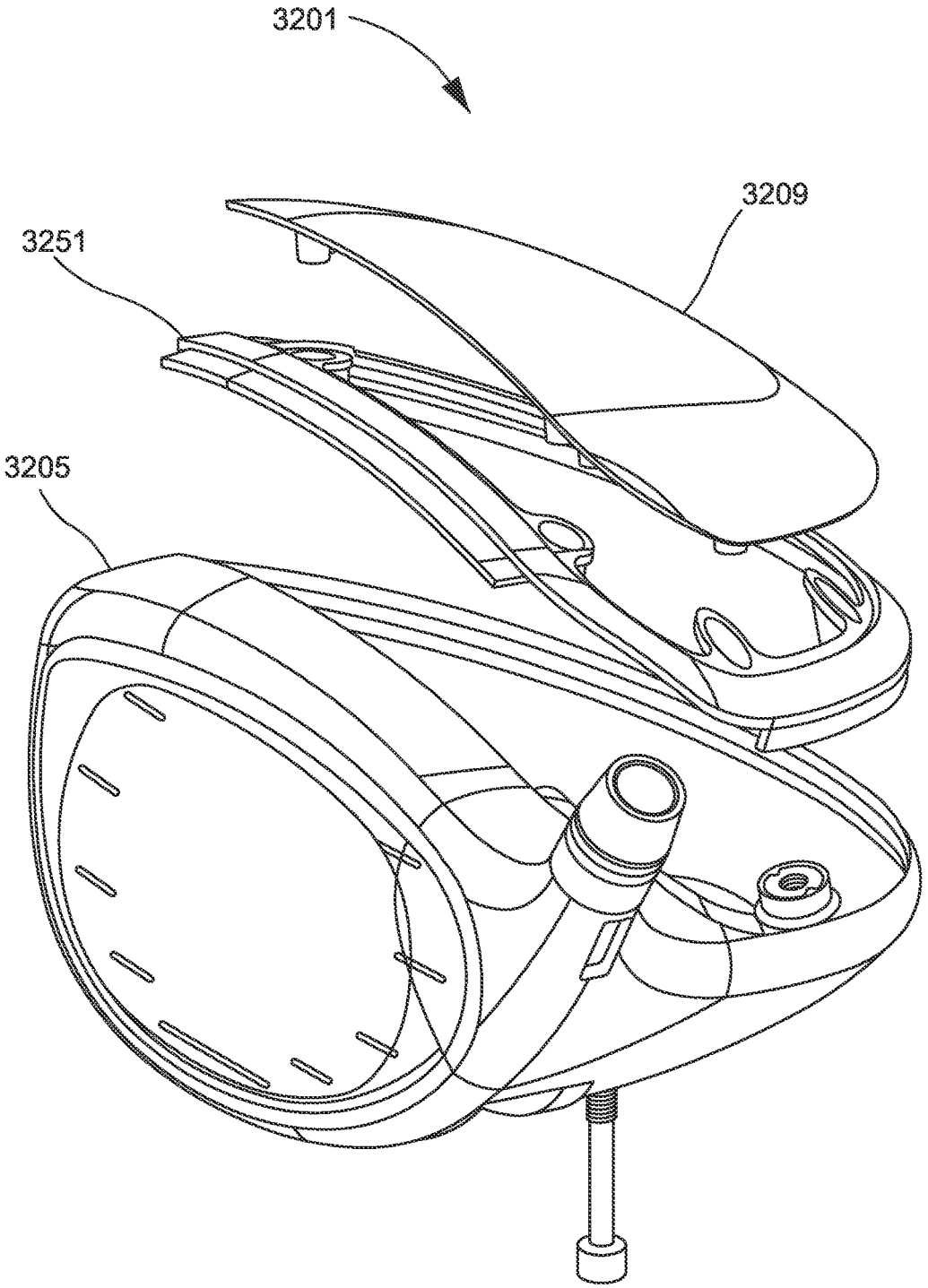
FIG. 32 depicts a removable component that sits on an intermediate piece.

FIG. 32 depicts an alternative embodiment in which removable component 3209 sits on an intermediate piece 3251. Intermediate piece may be affixed to club head body 3205. For example, intermediate piece 3251 may be composite, club head body 3205 may include titanium, and intermediate piece 3251 may be glued to club head body 3205. A benefit of using intermediate piece 3251 includes forgiving manufacturing tolerances. Since the fabrication of club head body 3205 is not the same process that creates the mating surface or interface for attachment to a removable component, the manufacturing process need not satisfy both tolerances simultaneously. The inner perimeter of the cutaway portion of club head body 3205 can have greater variation in manufacturing, as it will be fixed to intermediate piece 3251 and finished. For example, gaps can be filled (e.g., with urethane or glue) and the surface may be finished (e.g., sanded and painted). Intermediate piece 3251 may be manufactured so that the inner perimeter of the cutaway through it will precisely match the outer perimeter of removable component 3209.

Figure 33:
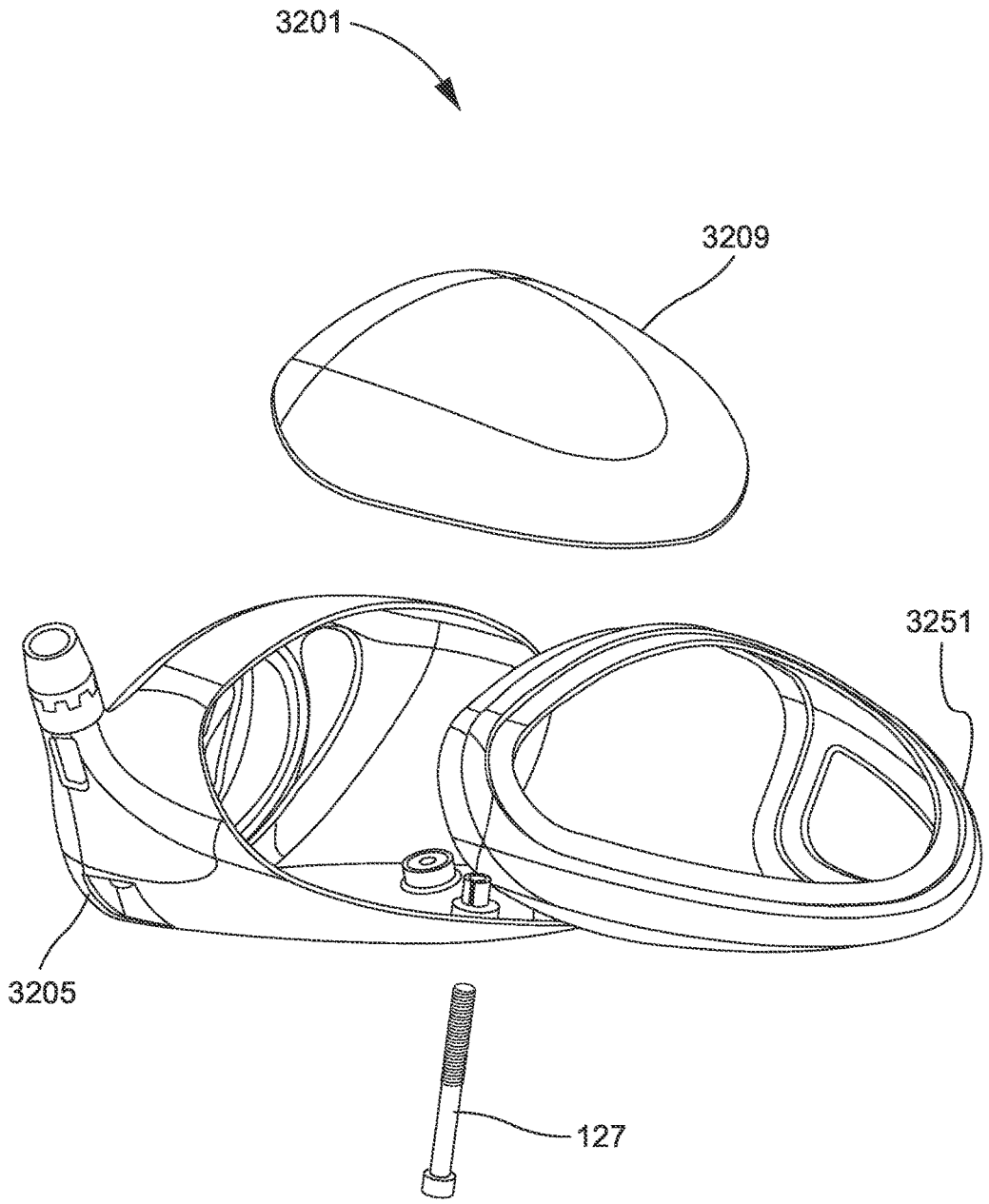
FIG. 33 depicts an intermediate piece fixed to a club head body.

FIG. 33 depicts a related embodiment in which intermediate piece 3251 is fixed to club head body 3205. Here, intermediate piece 3251 includes an aft-most portion of club head 3201 and extends somewhat into a sole region of the club head. Preferably, intermediate piece 3251 is made with a ledge that slides into body 3205 and provides a mating surface for adhesive. Piece 3251 may be cemented to body 3205, which may be, e.g., titanium. Intermediate piece 3251 may be made from any suitable material including metals and polymers. In some embodiments, intermediate piece 3251 includes carbon-fiber reinforced plastic.

Figure 34:
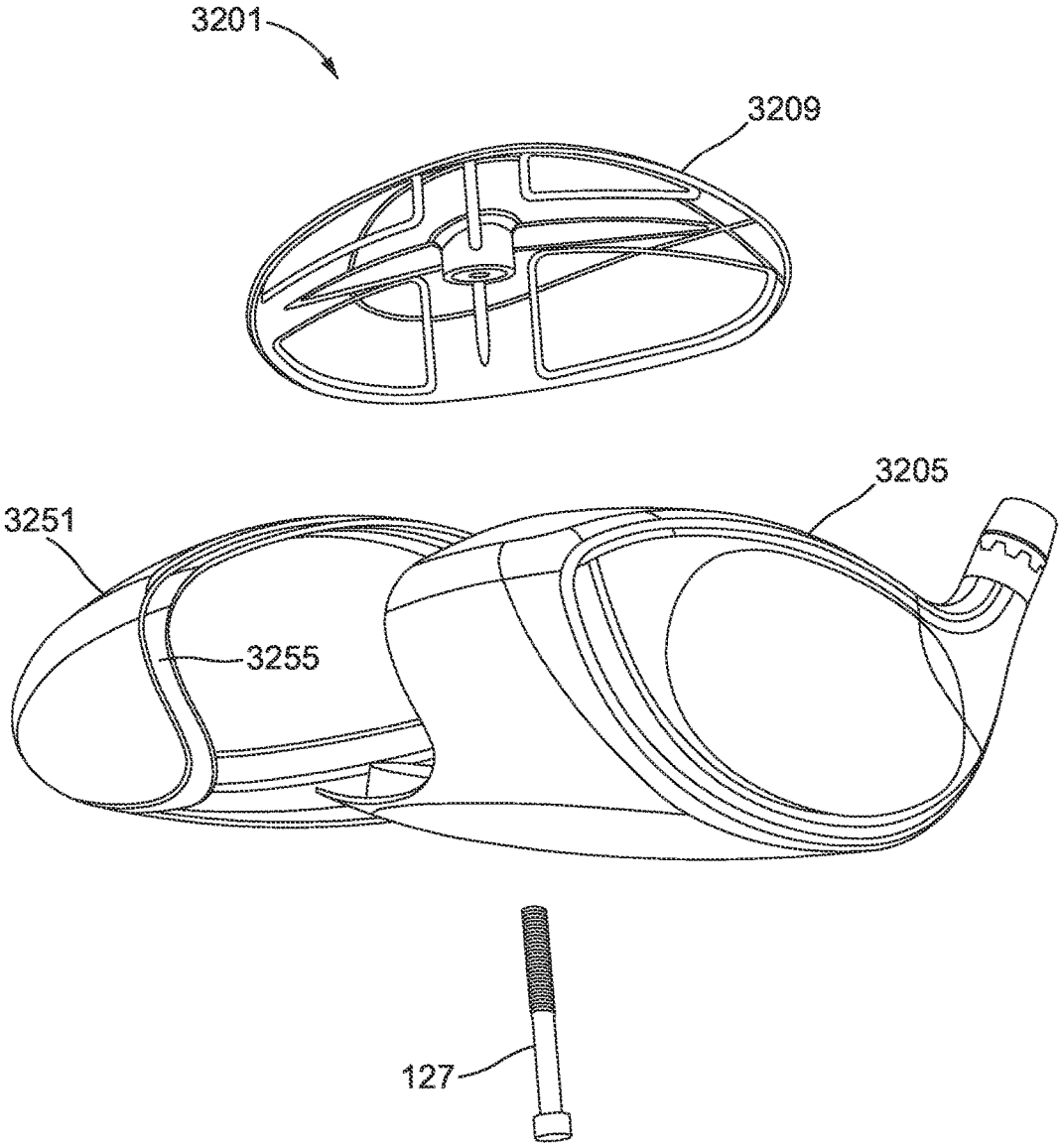
FIG. 34 gives another exploded view of club head.

FIG. 34 gives another exploded view of club head 3201 to illustrate assembly of removable crown 3209 to the club head. Here, intermediate piece 3251 is illustrate spaced away to aid visualization and will normally be glued to club head body 3205 by ledge 3255. For manufacturing, ledge 3255 slides into body 3205 and provides a contact surface for glue. Post-manufacturing, removable component 3209 can be attached or removed through the use of screw 127, which engages with a screw post in component 3209, as discussed above.

Figure 35:
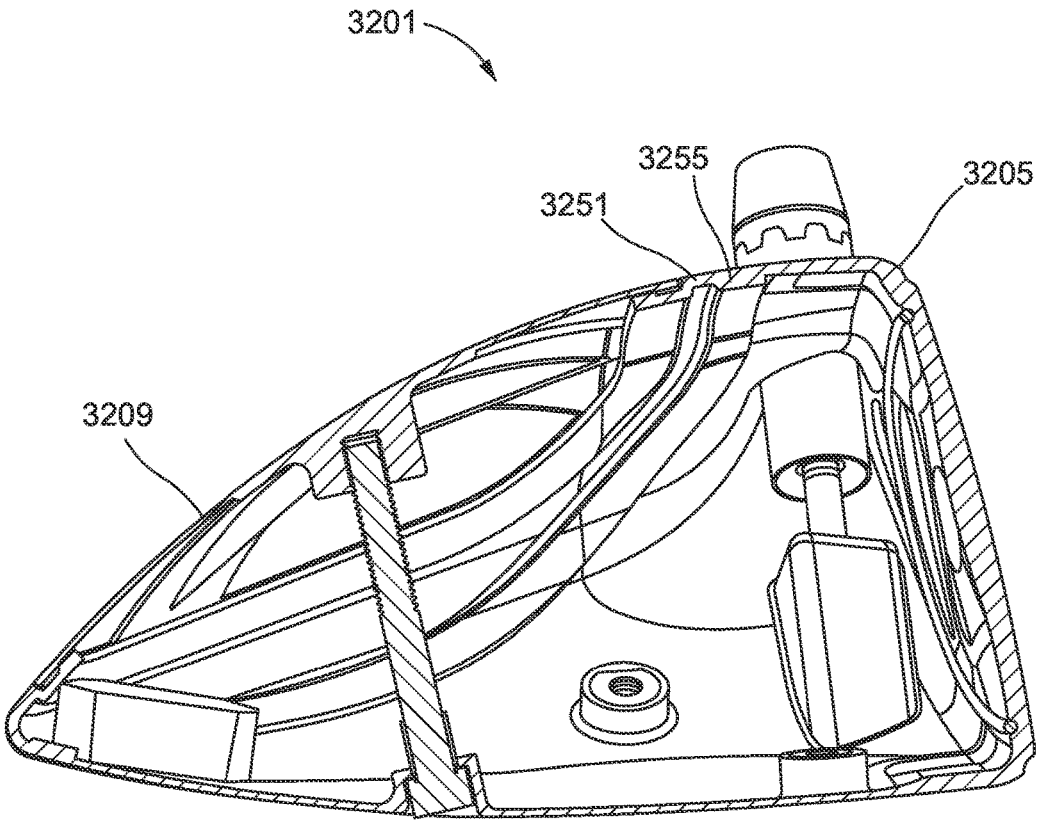
FIG. 35 presents a cutaway view through an assembled club head.

FIG. 35 presents a cutaway view through an assembled club head 3201, showing intermediate piece 3251 disposed between club head body 3205 and removable component 3209. It can be seen that ledge 3255 on intermediate piece 3251 extends inside of body 3205.

Figure 36:
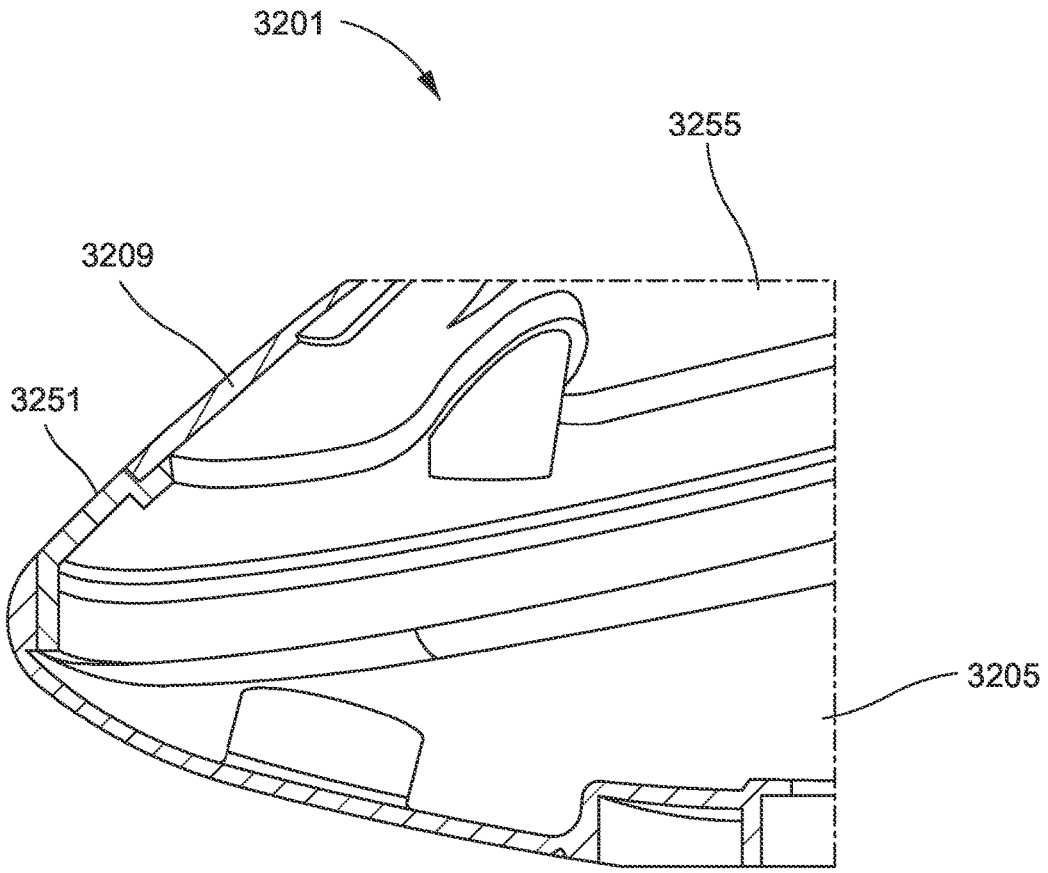
FIG. 36 gives a detail view of an aft-area junction between components.

FIG. 36 gives a detail view of an aft-area junction between components for certain embodiments of the invention. For the depicted embodiment, intermediate piece 3251 presents a ledge that extends down into body 3205. Removable component 3209 sits on a lip surrounding the cutaway through intermediate piece 3251.

Figure 37:
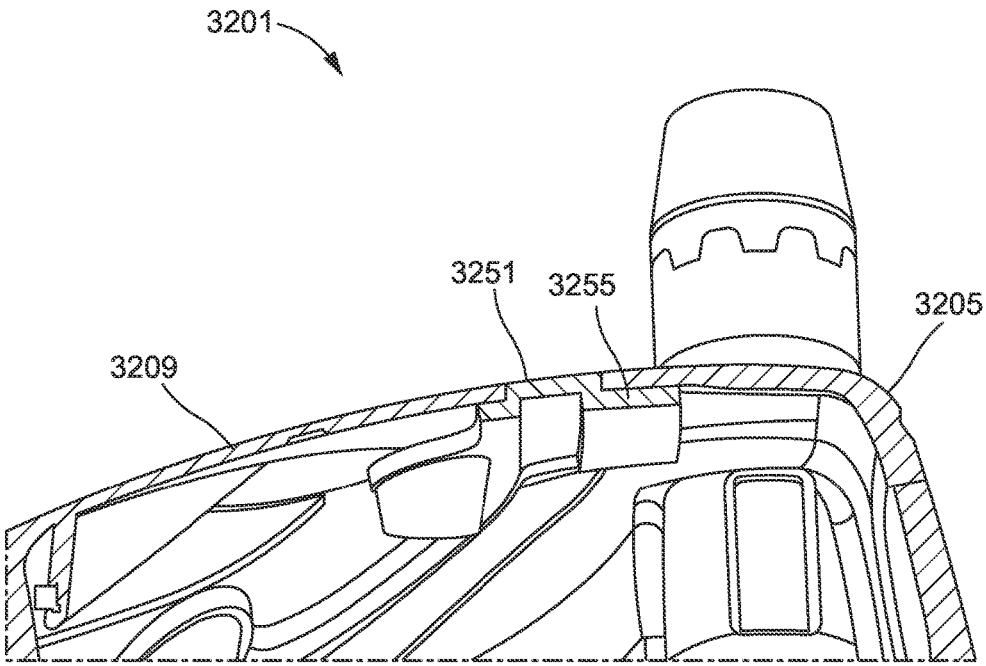
FIG. 37 gives a detail view of a forward-area junction between components.

FIG. 37 gives a detail view of a forward-area junction between components. Ledge 3255 of intermediate piece 3251 slides under body 3205. Here too, removable component 3209 sits on the lip surrounding the cutaway through intermediate piece 3251.

One insight of the invention includes the recognition that a golf club—particularly a driver type club—undergoes severe shock during routine play as the club is used to hit a ball at very high speeds. Including a cutaway hole in the overall hollow body of the club head can compromise its structural integrity. During the shock of a shot, the club head can deform, with severe deformation potentially being introduced at seed points around the outer periphery of a removable component or the inner periphery of a cutaway if these points are not adequately supported. The embodiments depicted herein address the structural requirements of such a club head, for example, at least by including a central post with radiating arms.

The invention includes any structure that provides a solid consistent compression of the crown with the body. In certain embodiments, a central post uses compressive stress to hold the removable component in place and the radiating arms distribute that stress uniformly about the periphery. In some embodiments, the structure includes circular, elliptical, or oblong channels that emanate from a post, or a structure with a tapering thickness, or a structure with a honeycomb or rectangular lattice structure to provide crown rigidity. Embodiments of the invention provide additional stabilization for the interface between the outer periphery of the removable component and the inner periphery of the cutaway in the form of a gasket or O-ring (see above), or in the form of an interlocking mechanism.

Figure 38:
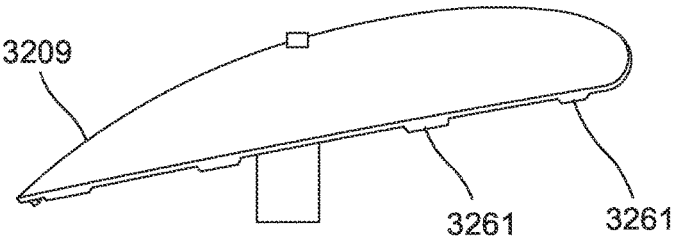
FIG. 38 depicts a removable component with a plurality of tabs.

FIG. 38 depicts an embodiment in which a removable component 3209 includes a plurality of tabs 3261 provided to interlock with corresponding recess on the club head (e.g., directly on club head body 105 or on intermediate piece 3251. To best stabilize assembled club head 101, it may be preferable to include a plurality of post 3261 (e.g., at least 6) distributed around the perimeter of the removable component.

Figure 39:
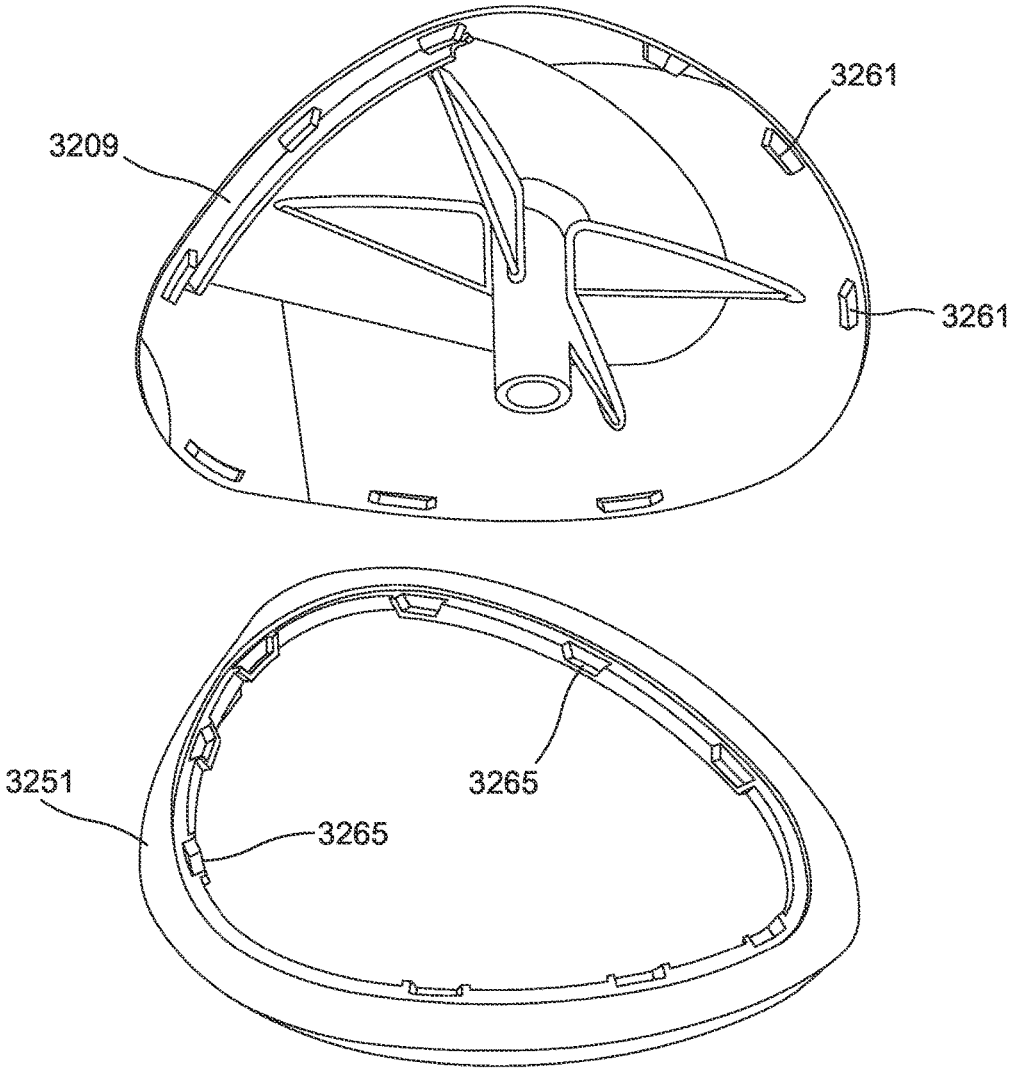
FIG. 39 shows a removable component and an intermediate piece.

FIG. 39 shows a relationship between a removable component 3209 and intermediate piece 3251. The inner periphery of the cutaway through intermediate piece 3251 includes a plurality of recess 3265, each corresponding to one of post 3261 on removable component 3209. The posts and recesses stabilize the component on the club and prevent an edge of the component from shearing away from an edge of the cutaway during play, thus preventing the club head's overall form from being compromised.

In general, embodiments of the invention provide a metal wood golf club head with an access door or removable component on the upper or lower surface. A club head of the invention may include a mass adjustment system, e.g., on the interior of the club. In some embodiments, an upper surface or lower surface attachable shell gives access to the internal surface of a metal wood club head. The shell is fastened (screws, rivets, etc.) and sealed with an adhesive system (tape or "bead") that prevents moisture from entering the head and provides good sound qualities. The adhesive system may not need strong adhesion to the door to be functional—e.g., it does not have to be excessively "sticky" to work. This may allow multiple installations and removals of the shell(s).

A mass adjustment system can be additive or subtractive. Additive mass systems have been illustrated and discussed above. An additive system is based on a minimum head structure that provides acceptable durability, sound, and ball launch conditions. The additive system than also uses mass that may be added. Additive mass may be provided by heavy tape, glued-in weights, screwed-in weights, "snap-in" weights, or any combination of them all to establish the optimum head weight, CG position and moment of inertia. In some embodiments, the head is originally formed through casting, stamping or composite build-up with no discretionary weight onboard—i.e. it is a light weight head. The head has basic functionality with good sound, acceptable durability, and acceptable golf ball launch conditions. Weight pad areas may be designated inside the head, for example, with markings for the placement of discretionary mass. Weights are located in specific combinations on the pad areas to obtain the desired head weight, center of gravity location, and moment of inertia. Weights can be heavy tape (commonly known as "lead tape"), snap-on, heavy metal infused thermoplastic, heavy metal infused rubber, heavy metal infused glue (i.e. "rat glue"), glued-on mass, screws, or others.

A subtractive system generally involves a club head that is manufactured to have a mass greater than a desired mass, such that the club can be customized by selectively removing mass. For example, a subtractive system may include specifically located weight pads that are molded (e.g., cast) into the head that can be machined away to establish the optimum head weight, CG position, or moment of inertia.

Figure 40:
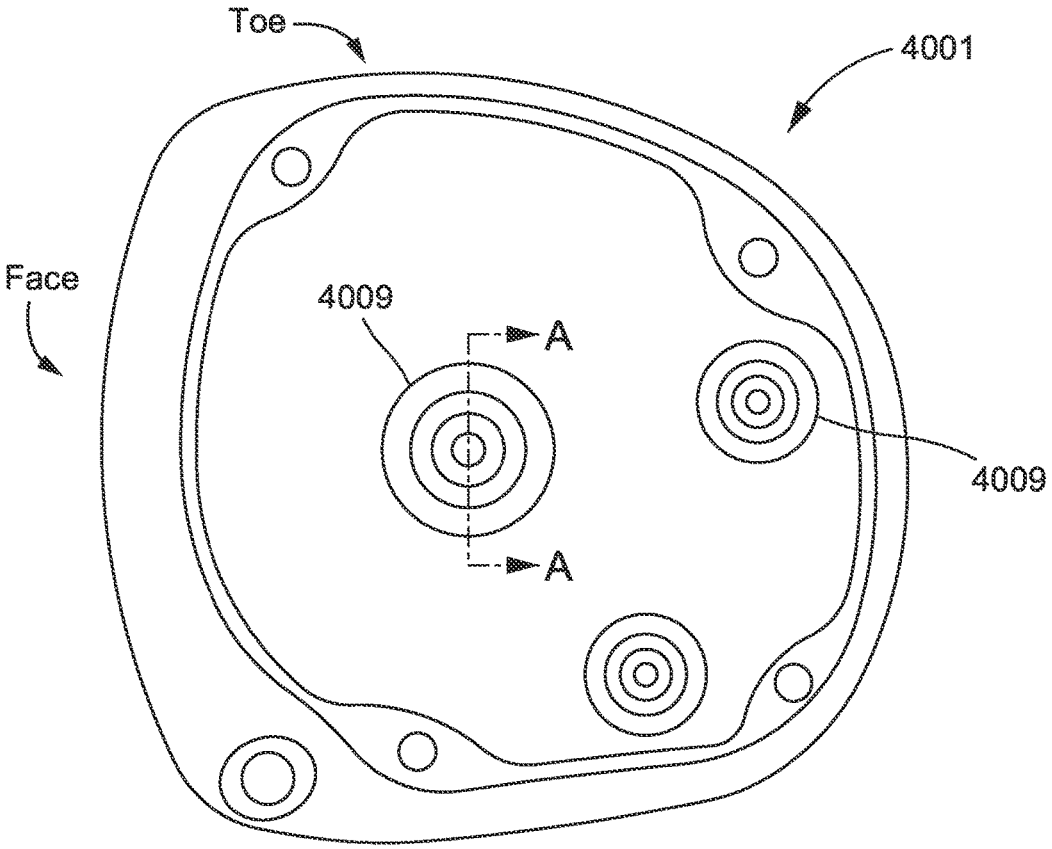
FIG. 40 shows a club head with a subtractive mass adjustment system.

FIG. 40 shows a club head 4001 with a subtractive system. Club head 4001 includes a plurality of mass pads 4009. Pad can be taken to mean a defined or raised area (e.g., in the sense that a concrete "pad" is poured when building a shed). Weight pads 4009 are preferably areas of the overall body shell of club head 4001 that are thicker than the surrounding areas. Weight pads 4009 are incorporated into the head (cast, stamped, welded) and the baseline head has excessive discretionary mass—i.e. it is heavy. The head has basic functionality, good sound, acceptable durability and acceptable golf ball launch conditions.

Figure 41:
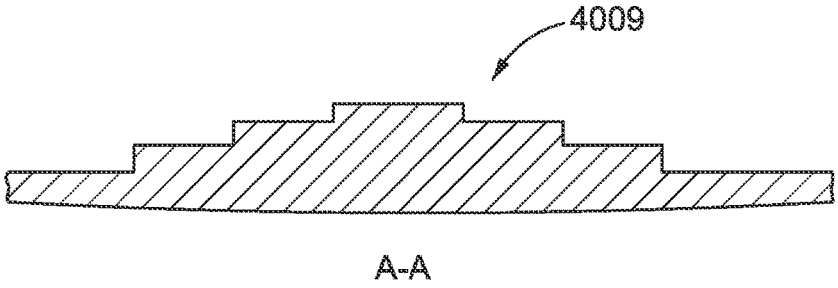
FIG. 41 gives a cross-section through a weight pad.

FIG. 41 gives a cross-section through a weight pad 4009 as manufactured initially in a club head 4001 with a subtractive system. The weight pads may be machined away in a specific pattern to obtain desired head weight, center of gravity location and moment of inertia. For example, a consultant at a pro-shop can use a rotary tool, such as the rotary tool sold under the trademark DREMEL with a grinding attachment, and can remove weight pads 4009 to bias the club head according to a golfer's swing style.

Other mass adjustment systems are provided by the invention for use in a golf club head.

Figure 42:
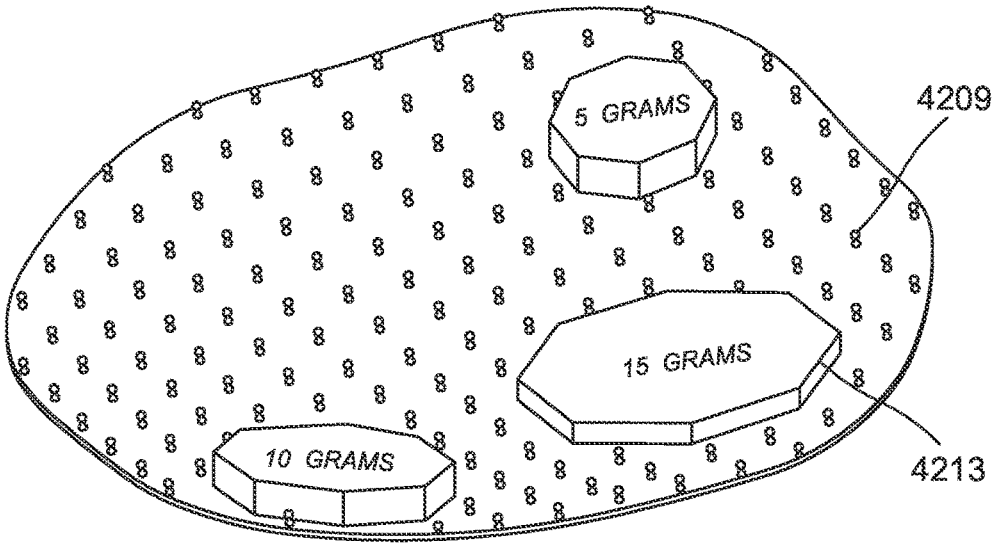
FIG. 42 shows an internal surface for a mass adjustment system.

FIG. 42 shows an internal surface for a mass adjustment system for a hollow golf club (e.g. driver). Attachment pegs 4209 are fixed to the interior surface of the sole (or other interior or exterior surface) of the golf club head. Pegs 4209 can be provided by a metal, polymer, or other suitable material. Pegs 4209 may be formed as part of the sole material or attached after the sole shape is formed. The depicted mass adjustment system may include one or a plurality of weight members 4213 for attaching to pegs 4209.

Figure 43:
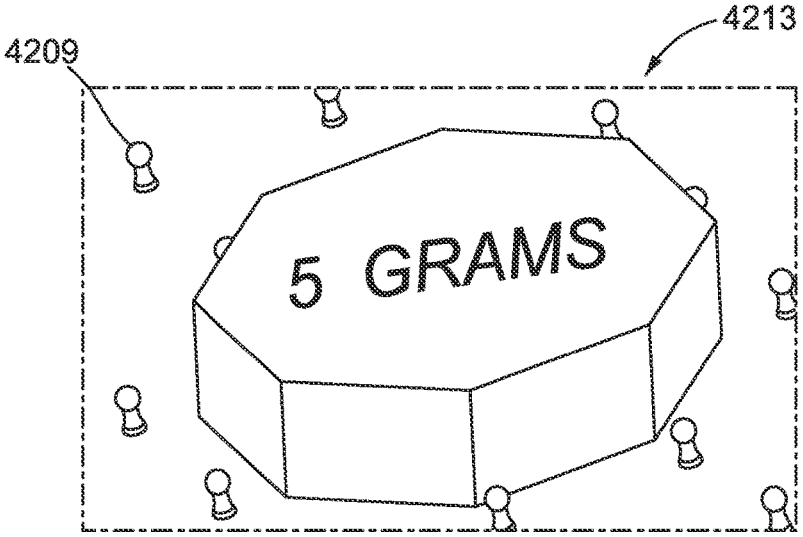
FIG. 43 gives a close-up of a weight member.

FIG. 43 gives a close-up of a weight member 4213. Weight member 4213 can include a pattern of holes on a bottom surface to correspond to a pattern of pegs 4209. In an alternative embodiment, weight member 4213 includes a material that is deformable enough that the weight member is initially whole and solid, but is pushed down over pegs 4209, causing the surface to break and receive pegs 4209 (e.g., a material like a rubbery gelatin) and may be made from silicone, rubber, a polymer, or a similar material. Weights 4213 can be made from a flexible polymer that forms to the shape of the sole surface and snaps onto the attachment pegs. Weights 4213 withstand the impact force when hitting the golf club, but can be removed by prying them off of the pegs. Weights 4213 may be various shapes, sizes, thicknesses and densities. Weights 4213 can be placed anywhere on the peg pattern to achieve desired performance attributes.

Figure 44:
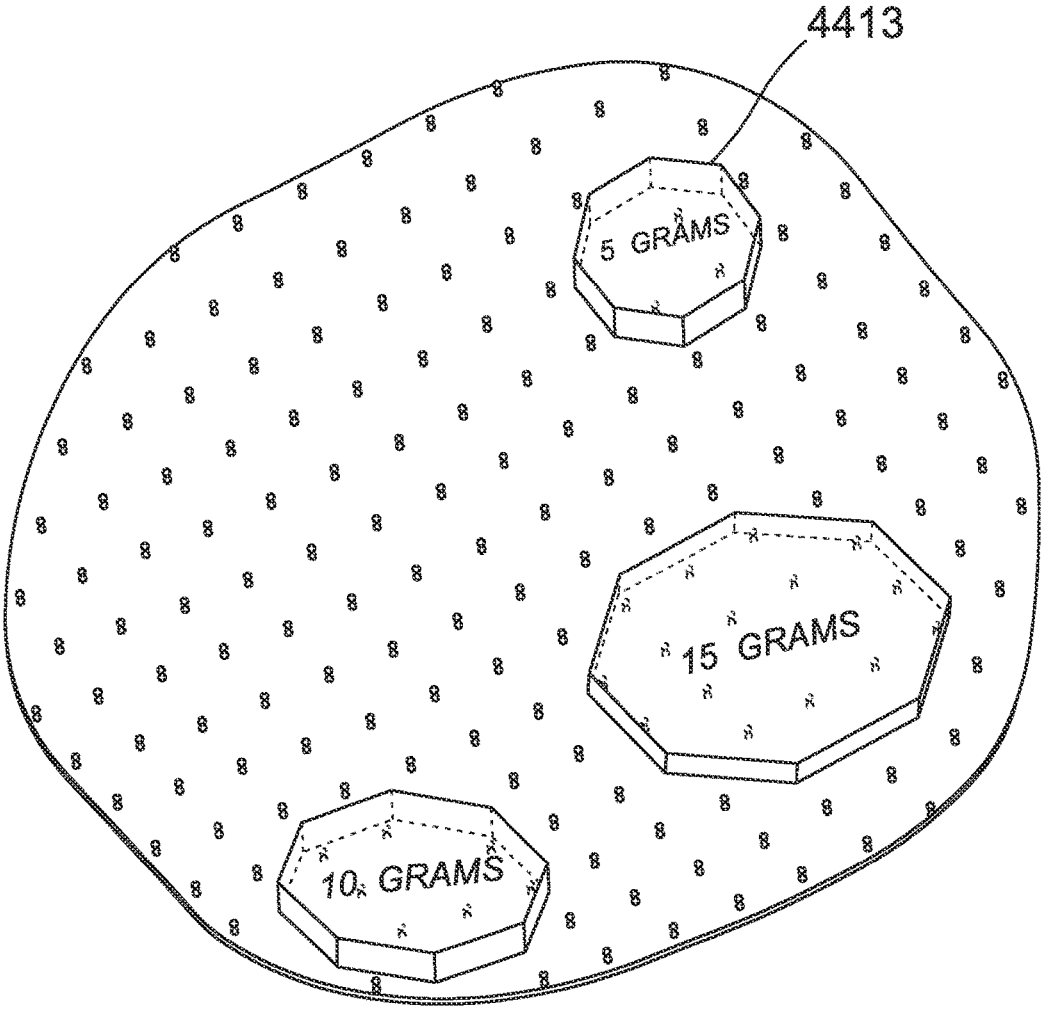
FIG. 44 shows a set including translucent weights.

FIG. 44 shows a set including translucent weights 4413. Translucent weights 4413 may be preferable to aid a user in understanding a mechanism by which the club head works. A golfer may view weights 4413 (e.g., as shown within FIG. 44) and see pegs 4209 that are inside of weight 4413 and intuitively understand that the weights 4413 are part of a repositionable weight set and understand that they can remove and reposition the weights.

Figure 45:
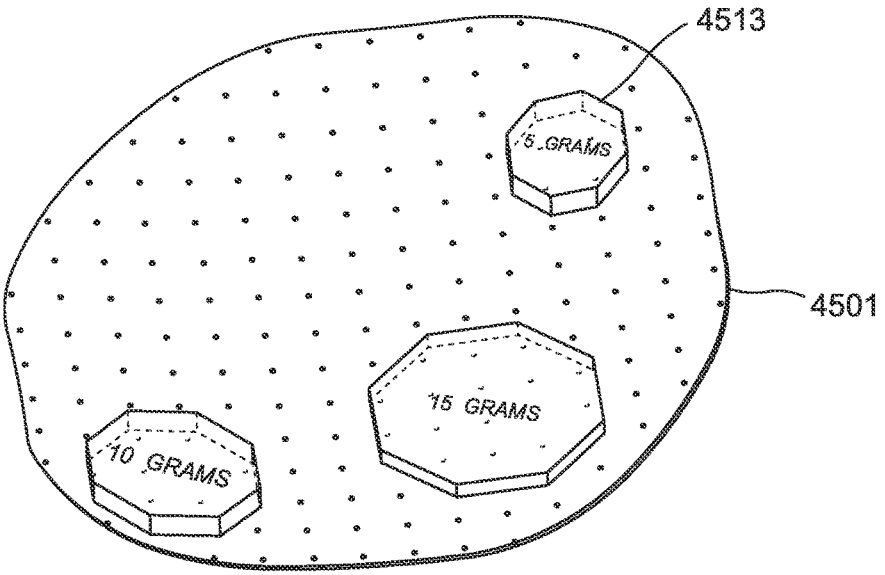
FIG. 45 depicts a false floor that includes holes for weight attachment.

FIG. 45 depicts a reversed embodiment in which a club head includes a false floor 4501 that includes holes for weight attachment. False floor 4501 is attached on the interior side of the sole of the golf club head.

Figure 46:
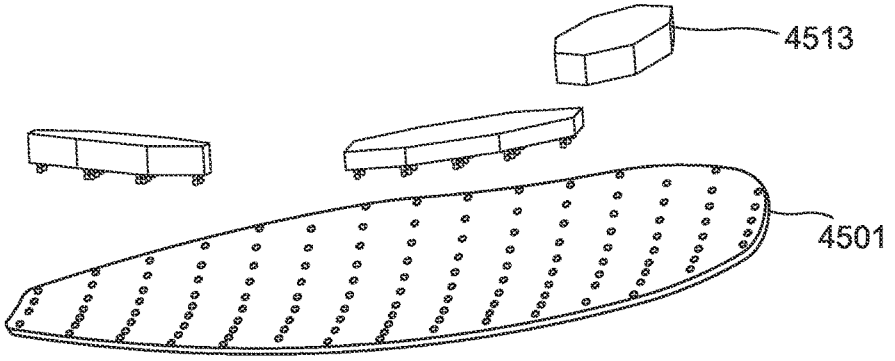
FIG. 46 shows weight members for attachment to holes.

FIG. 46 shows weight members 4513 for attachment to the holes in false floor 4501.

Figure 47:
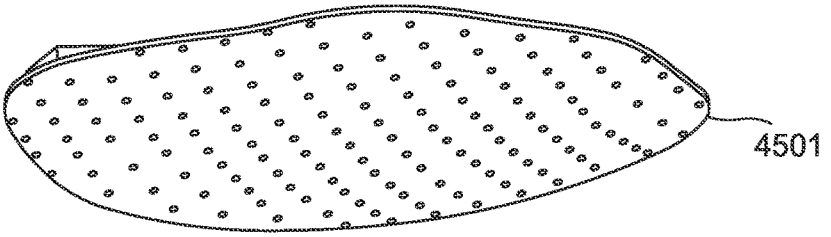
FIG. 47 shows an underside of a false floor.

FIG. 47 shows an underside of the false floor 4501. Flexible weights 4513 include pegs molded on the bottom that can snap into holes. Weights can be removed by prying them off. The pegs go through false floor to snap in place.

The invention provides mechanisms suitable for fastening a removable component to a club head.

Figure 48:
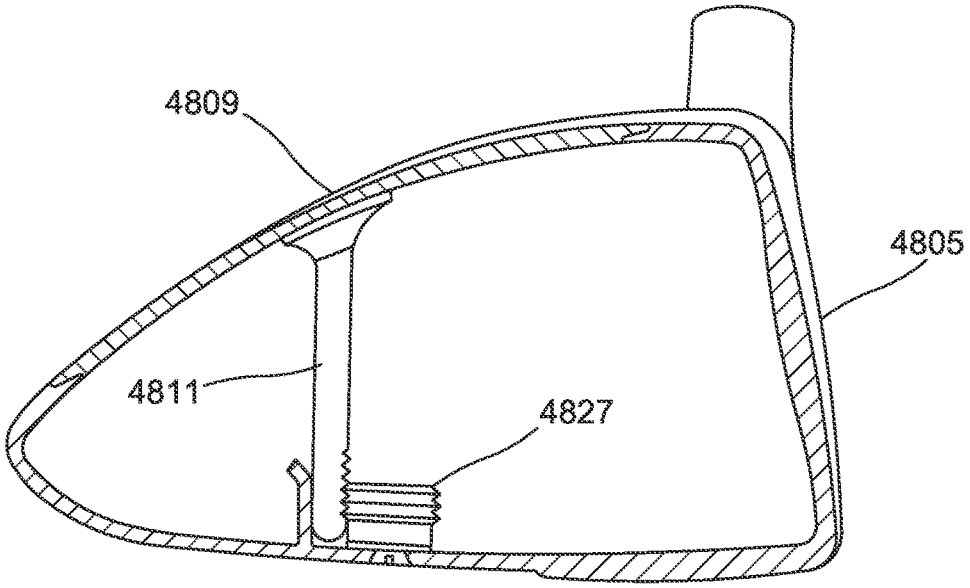
FIG. 48 shows a club head with a removable component.

FIG. 48 shows a club head 4801 with removable component 4809 that can be removed from main club head body 4805. Central post 4811 extends from removable component 4809 and has a grooved side of the post. Assembly screw 4827 is threaded and the threads engage the groove portion of post 4811. When screw 4827 is rotated from the outside, the threads pull down on central post 4811, fastening removable component 4809 to club head 4801.

Figure 49:
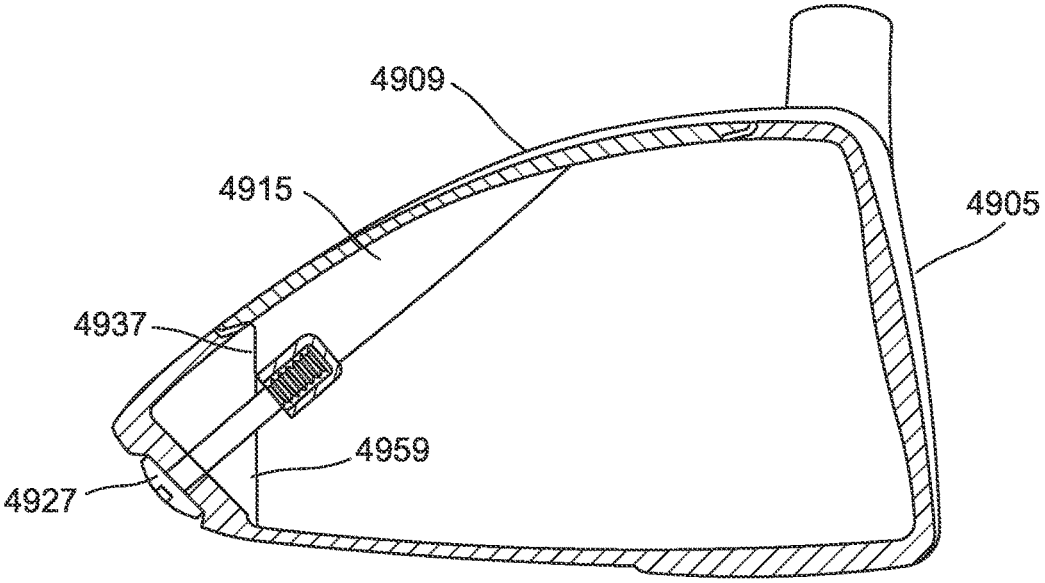
FIG. 49 depicts an assembly screw that fastens a removable component.

FIG. 49 depicts an alternative embodiment in which assembly screw 4927 fastens removable component 4909 to main club head body 4905. Component 4909 may include molded PEEK part 4915, attached with adhesive and molded with metal thread insert. When screw 4927 tightens, interface surfaces 4937 make contact and translate force downward. Preferably, screw 4923 is captured loosely within boss 4959 on main club head body 4905.

Figure 50:
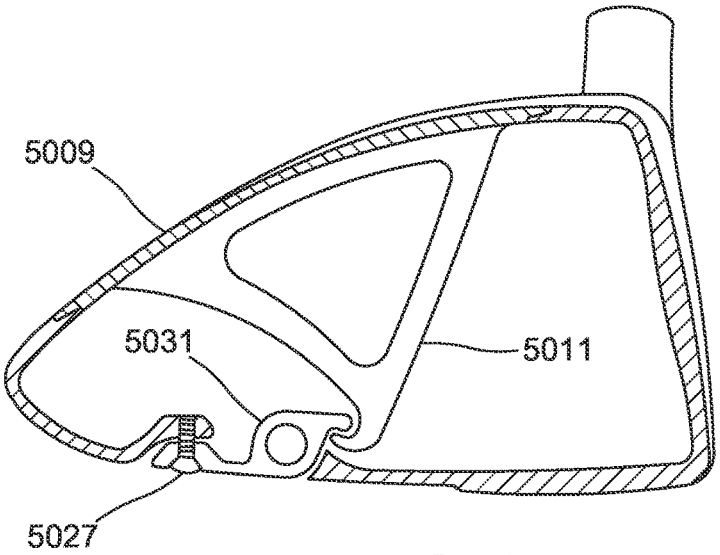
FIG. 50 illustrates a screw-down clamp mechanism.

FIG. 50 illustrates a screw-down clamp mechanism that includes a clamp 5031. Assembly screw 5027 pushes one edge of clamp 5031, which thus engages and pulls down on mounting buttress 5011 of removable component 5009.

Figure 51:
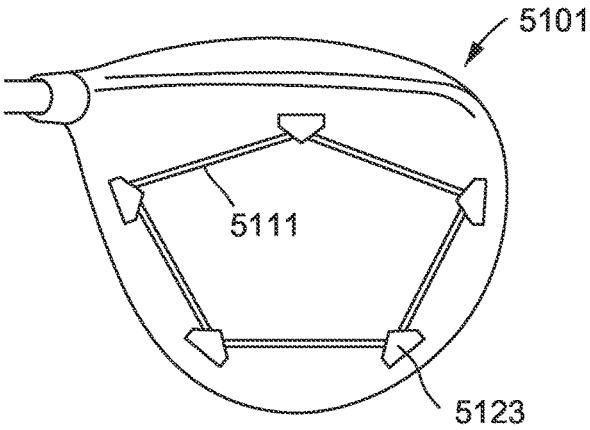
FIG. 51 shows the use of a rigging mechanism.

FIG. 51 shows the use of a rigging mechanism in which rigging line 5111 extends through a system of cleats 5123 inside of club head 5101.

Figure 52:
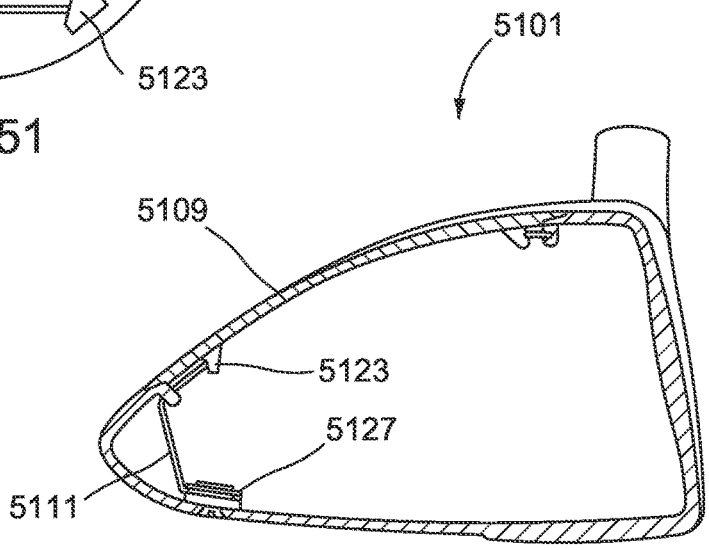
FIG. 52 shows a capstan screw.

FIG. 52 shows capstan screw 5127 in club head 5101. Rigging line 5111 spools around capstan screw 5127 such that when the screw is rotated, it takes up rigging line 5111. This applies tension to removable component 5109 through cleats 5123 mounted to removable component 5109. The illustrates rigging mechanism based on rig-line 5111, since it is tensioned by capstan screw 5127, stabilizes club head 5101, providing a club head that is enjoyable to play.

Figure 53:
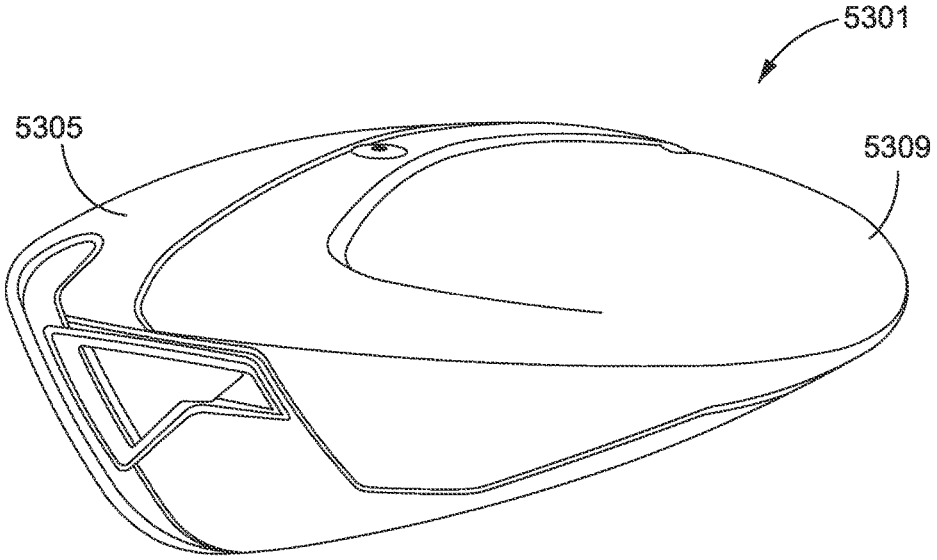
FIG. 53 shows a club head with an openable hatch.

FIG. 53 shows a club head 5301 with an openable hatch 5309 connected to main club head body 5305.

Figure 54:
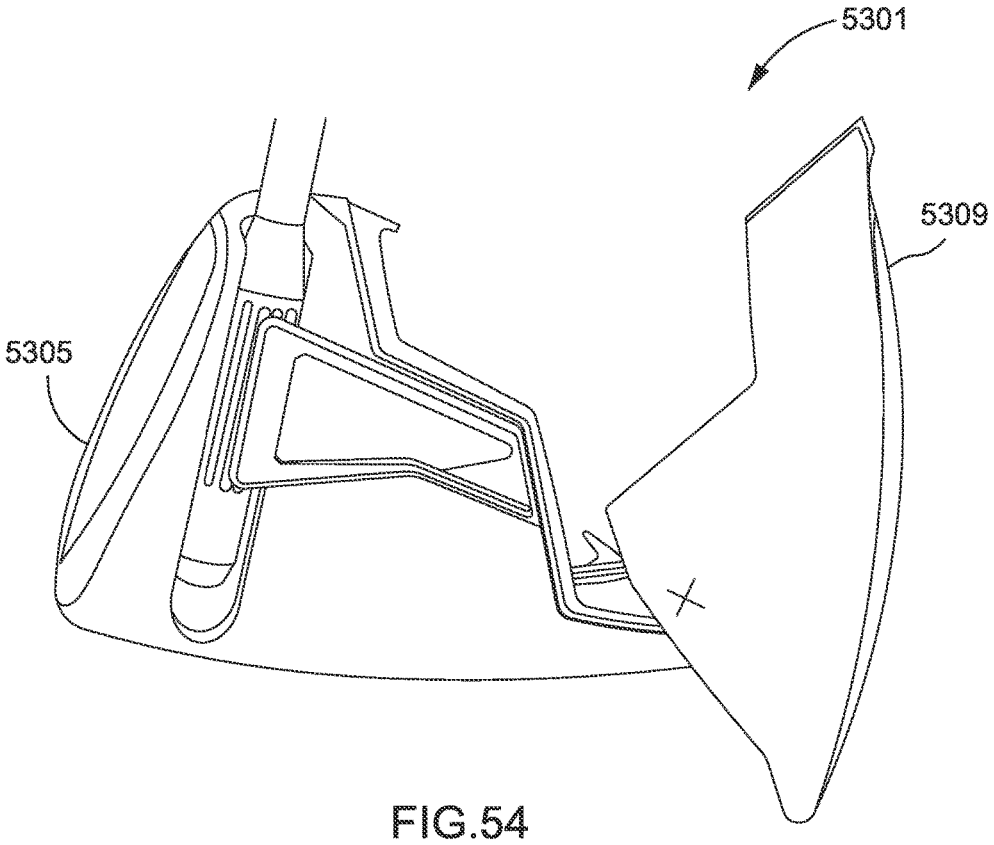
FIG. 54 an shows openable hatch lifted around its hinged axis.

FIG. 54 shows openable hatch 5309 lifted around its hinged axis to reveal an interior of club head 5301. The depicted structure may be a preferred embodiment, since 5309 is not immediately separable from club head 5301 and thus will remain with the club head.

Figure 55:
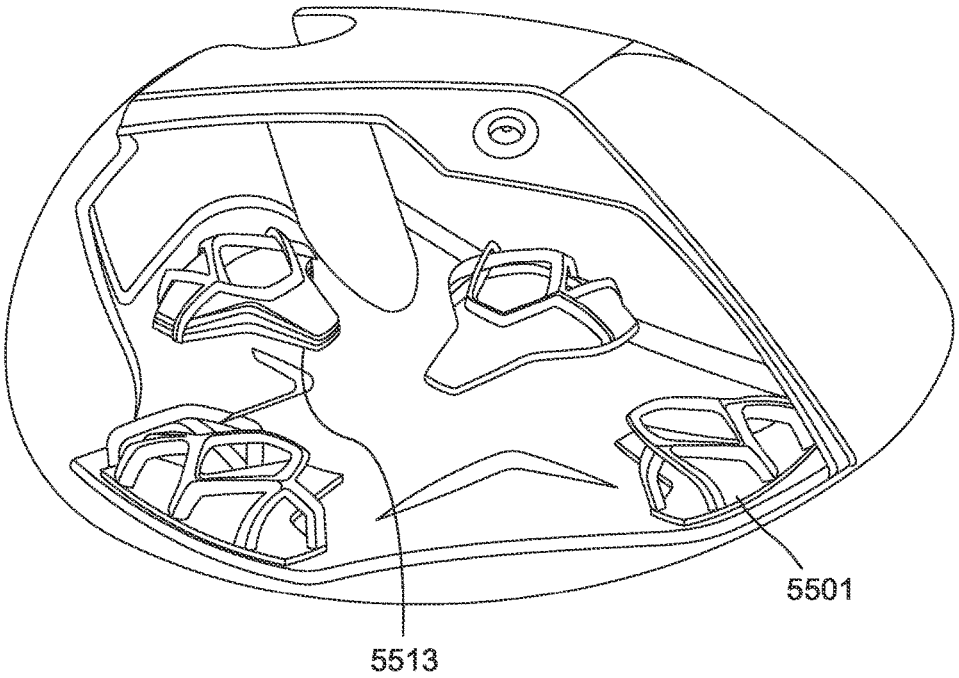
FIG. 55 shows mount points retaining weight members.

FIG. 55 shows mount points 5501 retaining weight members 5513.

Figure 56:
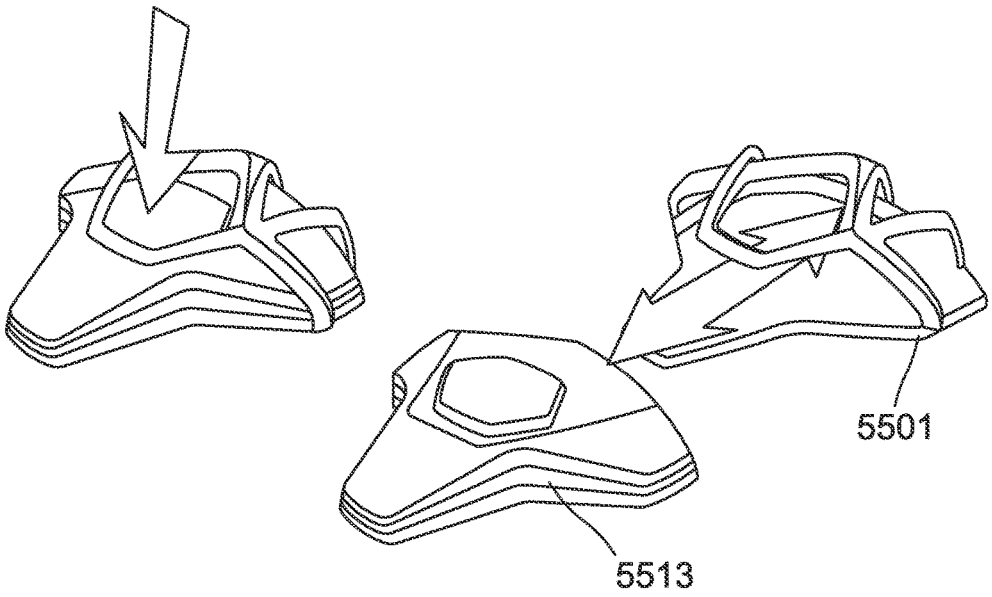
FIG. 56 shows a mount point and a weight member.

FIG. 56 shows a mount point 5501 and a weight member 5513 as shown inside of a club head in FIG. 55. It can be seen that weight members 5513 may include a button that can be pressed to release them from mount points 5501 and that weight members may be inserted by sliding them into mount points 5501. It may be found preferable to use non-round weight members so that they do not rotate during use of the club head. The cage shape of mount points 5501 may be preferred for fastening the weight members therein.

Figure 57:
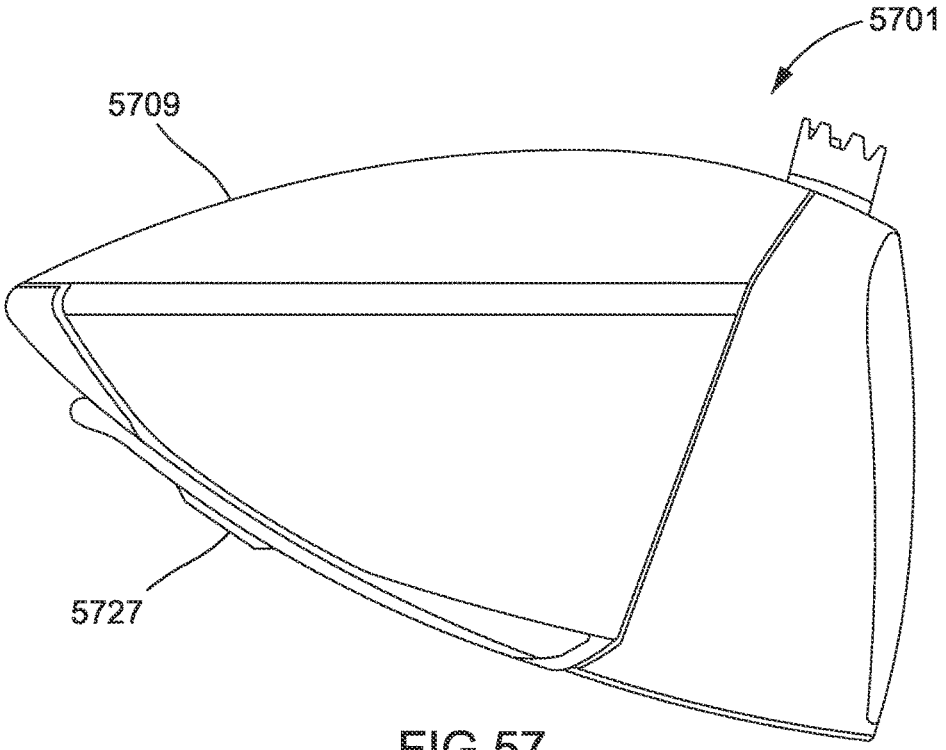
FIG. 57 shows a club head with a removable component.

FIG. 57 shows a club head 5701 with removable component 5709 fastened by assembly screw 5727 according to certain embodiments.

Figure 58:
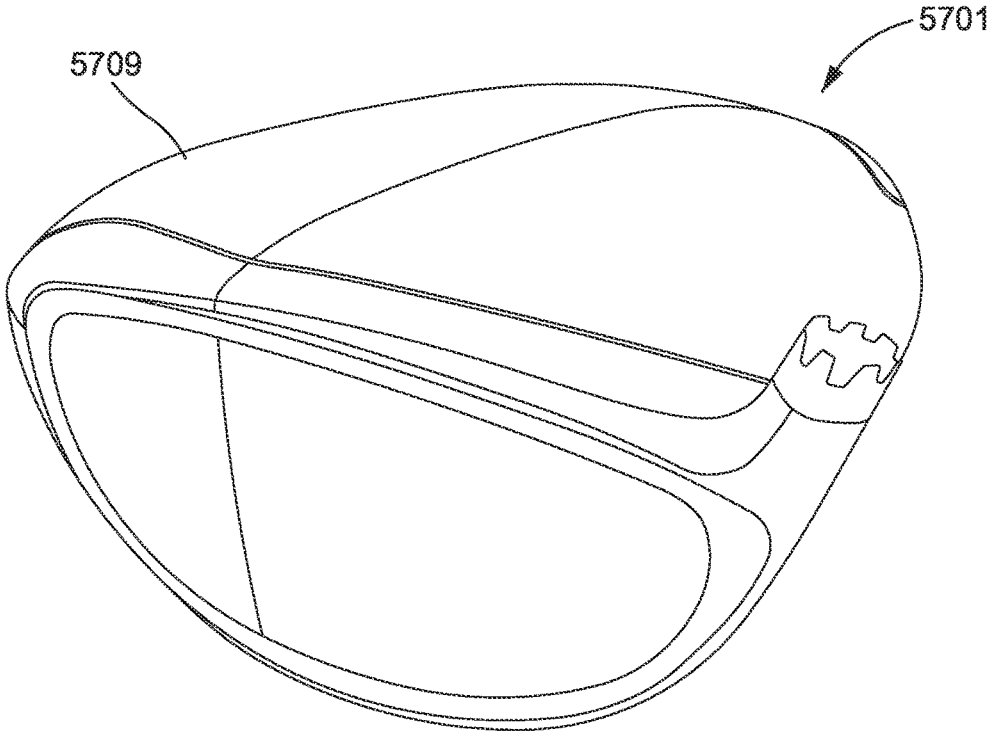
FIG. 58 gives a perspective view of a club head.

FIG. 58 gives a perspective view of club head 5701.

Figure 59:
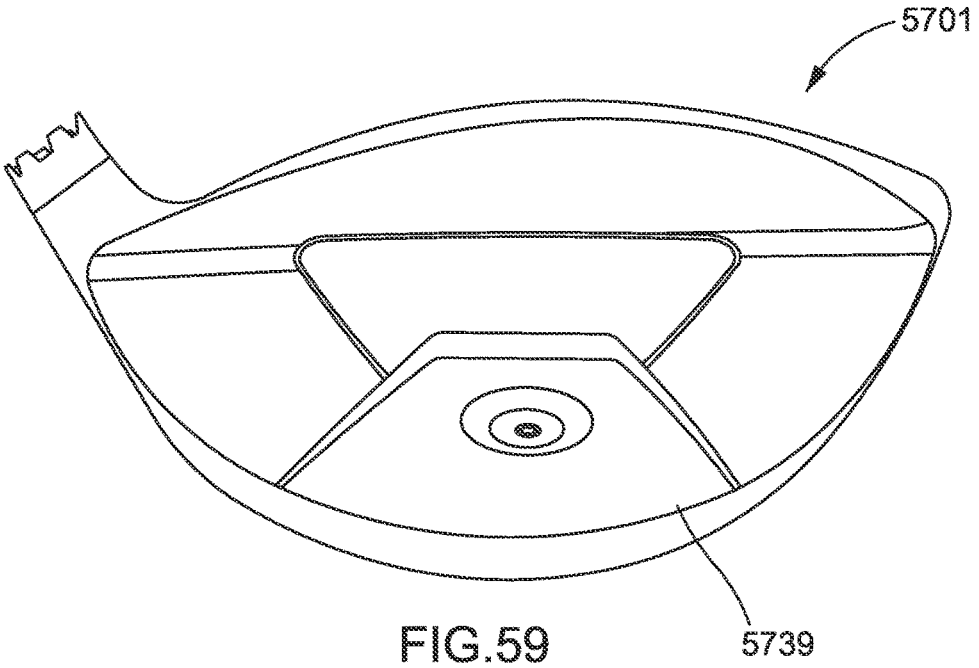
FIG. 59 shows the back of a club head.

FIG. 59 shows the back of club head 5701 to reveal lever 5739 being held in place by assembly screw 5727.

Figure 60:
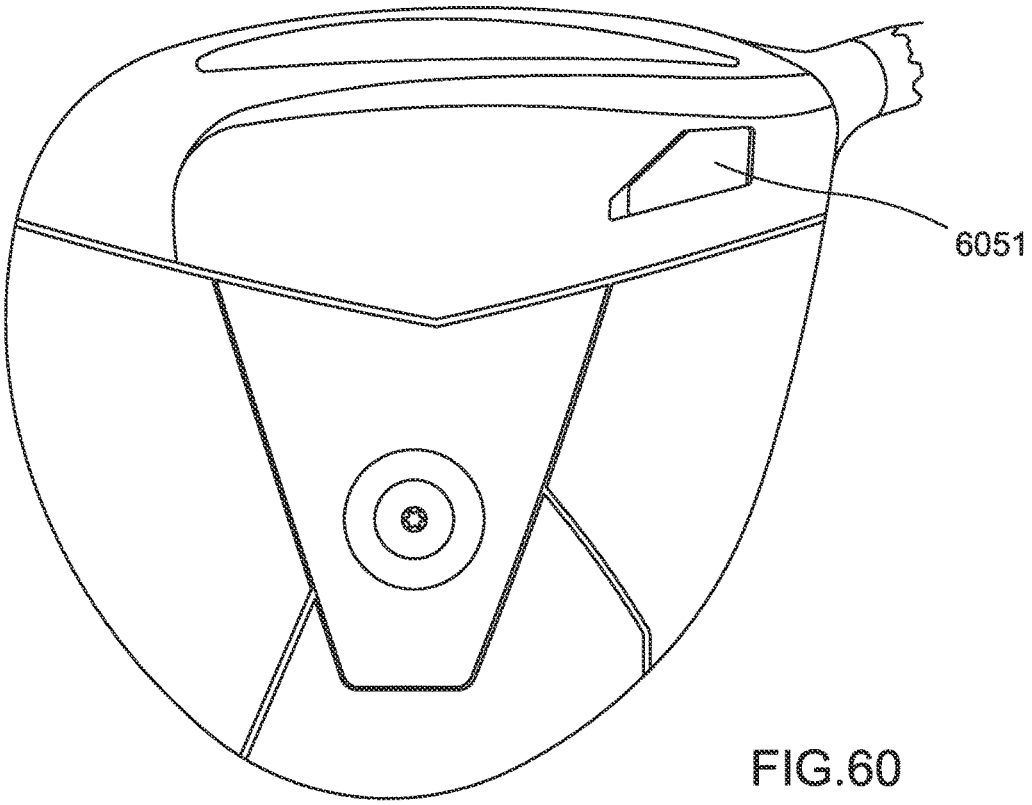
FIG. 60 gives a bottom view of a club head.

FIG. 60 gives a bottom view of club head 5701. Shaft cam lever 6051 is visible. Lever 5739 is a central component of the assembly mechanism of club head 5701 and FIGS. 61-63 illustrate the operation of the assembly mechanism.

Figure 61:
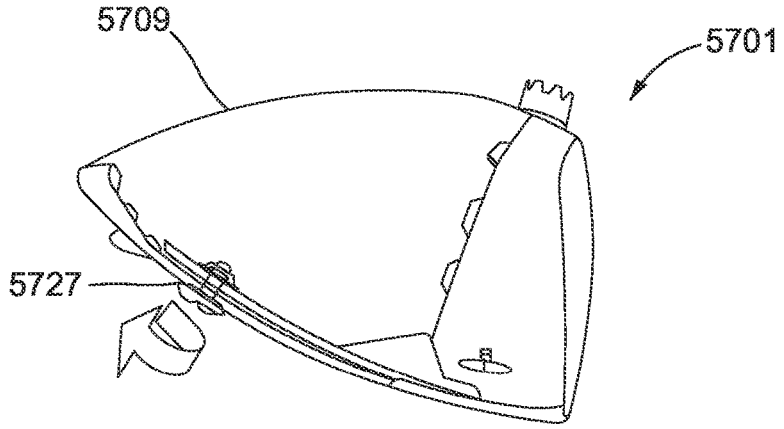
FIG. 61 illustrates turning a screw to unlock a removable component.

FIG. 61 illustrates turning screw 5727 to unlock removable component 5709.

Figure 62:
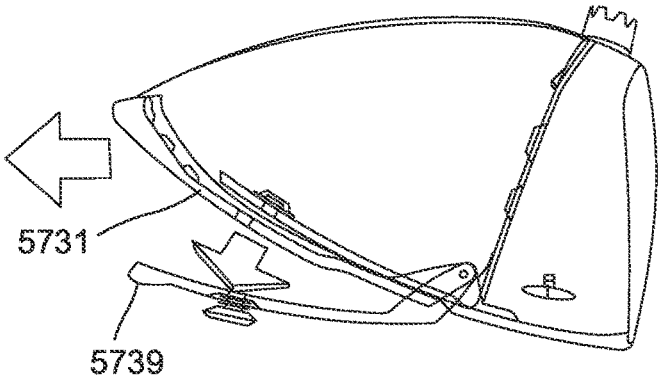
FIG. 62 shows pulling a lever to slide back a clamp.

FIG. 62 shows a second step—pulling lever 5739 to slid back clamp 5731.

Figure 63:
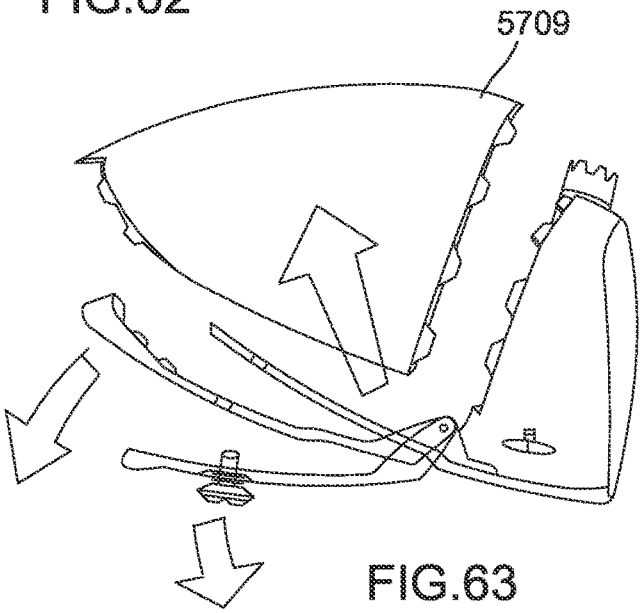
FIG. 63 shows removing a cover.

FIG. 63 shows the final step. A user may continue to pull on lever 5739. Clamp 5731 drops, allowing cover 5709 to be removed.

Figure 64:
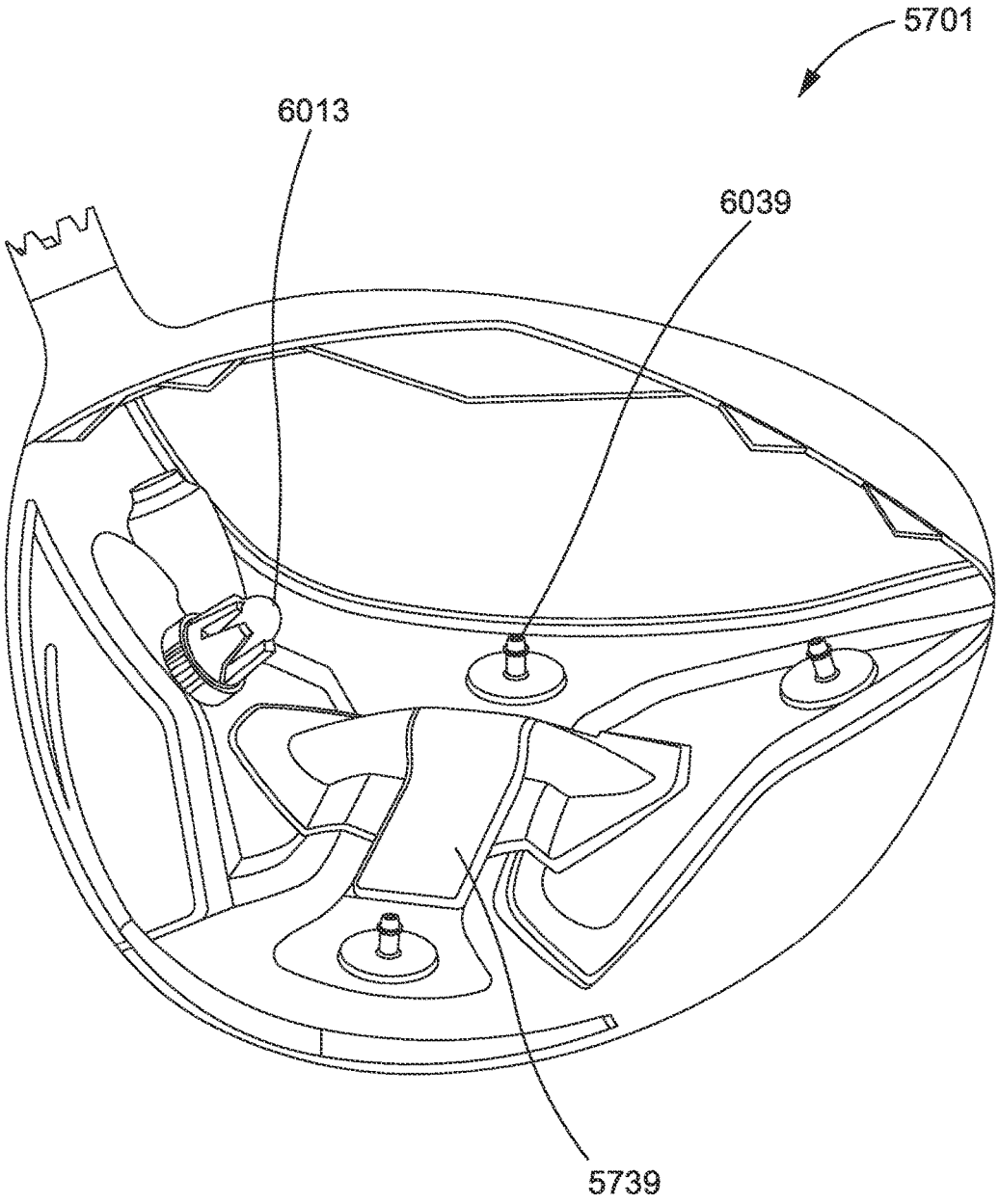
FIG. 64 shows an interior of a club head.

FIG. 64 shows the interior of club head 5701 in some embodiments and depicts an alternative mass adjustment system of certain embodiment. The depicted system includes one or a plurality of assembly posts 6039 to which a mass member 6013 may be fastened. Mass member 6013 may be deformable with an internal shoulder that snaps over the flared head of post 6039. A person can squeeze mass member 6013, causing the internal shoulder to deform away from the flared head of post 6039, allowing mass member 6013 to then be simply lifted off of post 6039. Additionally or alternatively, mass member 6013 can be provided for one-time mounting on posts 6039. Mass members 6013 may be non-deformable and may include an internal shoulder that snaps onto post 6039. Mass members 6013 may be mounted to posts 6039 by an adhesive (e.g., epoxy). In certain embodiments, posts 6039 and mass members 6013 are both threaded and mass members 6013 are screwed onto posts 6039.

Figure 65:
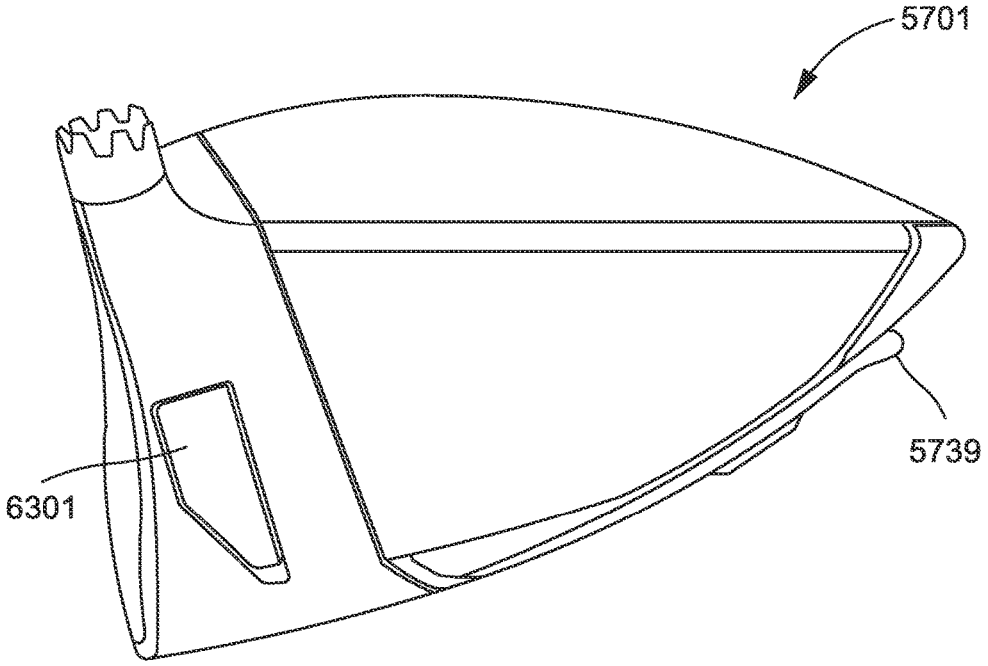
FIG. 65 shows a cam lever on a club head.

FIG. 65 shows cam lever 6301 on club head 5701 for fastening a shaft to the club head.

Figure 66:
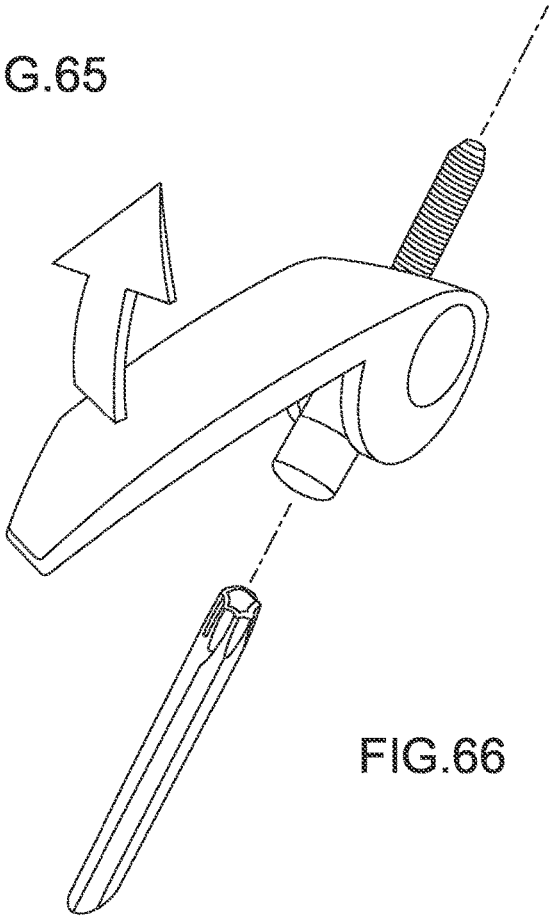
FIG. 66 illustrates the cam lock mechanism provided by a shaft cam lever.

FIG. 66 illustrates the cam lock mechanism provided by shaft cam lever 6051. The depicted mechanism may be included to allow a golfer to easily adjust their shaft-club head attachment.

Figure 67:
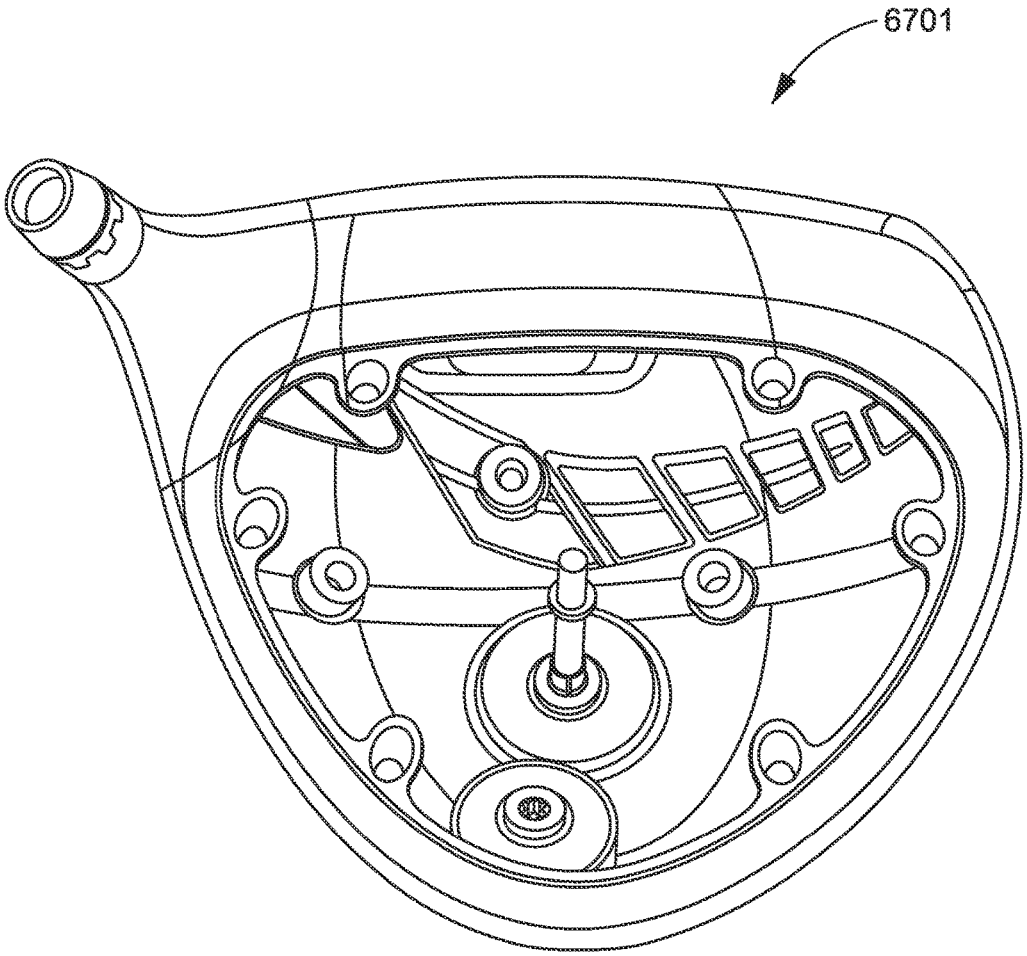
FIG. 67 depicts an alternative embodiment for a club head of the invention.

FIG. 67 depicts an alternative embodiment for a club head 6701 of the invention. Here, the weight mount points need not include a threaded insert. As discussed above, the threads may be tapped in or machined in. Alternatively, the weight members can be non-threadably mounted, e.g., by snap-fit or by adhesives.

As used herein, the word "or" means "and or or", sometimes seen or referred to as "and/or", unless indicated otherwise. Any documents referenced in the disclosure are hereby incorporated herein by reference in their entirety for all purposes.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

References and citations to other documents, such as patents, patent applications, patent publications, journals, books, papers, web contents, have been made throughout this disclosure. All such documents are hereby incorporated herein by reference in their entirety for all purposes.

EXAMPLES

Example 1

Club heads were made that had a removable crown and did not include a structure of the invention. It was found that the main club head body broke on impact. Without being bound by any particular mechanisms, it may be theorized that the structures of the invention cause the body to compress and tension the crown in harmony with the body when the body deforms, thus providing support and avoiding breakage.

What is claimed is:

1. A golf club head assembly comprising:

a club head body comprising a sole, a crown, a face, and a hosel;

a removable component configured to be removed from and re-attached to a mounting portion of the club head body, wherein the removable component forms a portion of the club head body and when attached to the mounting portion fully encloses an interior space within the club head body; and the removable component comprises a fastening mechanism that includes a post connected to the removable component by a plurality of radiating truss structures, and when the removable component is attached to the mounting portion of the club head body, the post extends into the interior space of the club head body, and the plurality of radiating truss structures distributes a holding force across the removable component to equalize forces around a periphery of the removable component where the removable component engages the club head body.

2. The club head assembly of claim 1, wherein the fastening mechanism comprises a receiving member configured to receive a screw such that, when the removable component is coupled to the club head body, the screw extends through the interior space of the club head body.

3. The club head assembly of claim 2, wherein the screw extends from the crown to the sole across the interior space of club head body.

4. The club head assembly of claim 2, wherein the screw is substantially vertical when the club head is at address.

5. The club head assembly of claim 2, wherein the club head body includes a boss with the screw extending therethrough, the screw being threadably engaged with the receiving member of the fastening mechanism of the removable component.

6. The club head assembly of claim 1, wherein the removable component comprises a portion of the crown.

7. The club head assembly of claim 6, wherein the removable component comprises a majority of the crown.

8. The club head assembly of claim 1, wherein the removable component comprises a portion of the sole.

9. The club head assembly of claim 8, wherein the removable component comprises a majority of the sole.

10. The club head assembly of claim 1, wherein the club head body comprises a first piece defining the hosel and surrounding the face, and an intermediate piece connected to the first piece and defining a cutaway with an inner periphery defining an attachment perimeter for attaching the removable component.

11. The club head assembly of claim 10, wherein the attachment perimeter includes a plurality of tabs and corresponding recesses.

* * * * *